US006592502B1

(12) United States Patent
Phillips

(10) Patent No.: US 6,592,502 B1
(45) Date of Patent: Jul. 15, 2003

(54) METHOD AND APPARATUS FOR ENHANCING PHYSICAL AND CARDIOVASCULAR HEALTH, AND ALSO FOR EVALUATING CARDIOVASCULAR HEALTH

(75) Inventor: Edward H. Phillips, Troy, MI (US)

(73) Assignee: RLE Corporation, Troy, MI (US)

( * ) Notice: Subject to any disclaimer, the term of this patent is extended or adjusted under 35 U.S.C. 154(b) by 235 days.

(21) Appl. No.: 09/619,881

(22) Filed: Jul. 20, 2000

Related U.S. Application Data

(60) Provisional application No. 60/146,741, filed on Aug. 2, 1999, provisional application No. 60/165,756, filed on Nov. 16, 1999, provisional application No. 60/097,206, filed on Aug. 29, 1998, and provisional application No. 60/099,378, filed on Sep. 8, 1998.

(51) Int. Cl.[7] ..... A63B 21/04

(52) U.S. Cl. ..... 482/143; 482/121; 482/123; 601/23

(58) Field of Search ..... 482/1–9, 51, 66, 482/92, 114–116, 120–127, 143; 601/23, 24, 26; 434/247

(56) References Cited

U.S. PATENT DOCUMENTS

| | | | | |
|---|---|---|---|---|
| 4,403,773 A | | 9/1983 | Swann | 482/145 |
| 4,659,077 A | * | 4/1987 | Stropkay | 482/70 |
| 5,029,848 A | | 7/1991 | Sleamaker | |
| 5,449,336 A | | 9/1995 | Sabel | 482/130 |
| 5,496,246 A | | 3/1996 | Pierre | 482/130 |
| 5,820,519 A | * | 10/1998 | Slenker | 482/4 |
| 6,228,004 B1 | * | 5/2001 | Steinback et al. | 482/121 |

OTHER PUBLICATIONS

Brochure entitled EECP Treatment, an educational service of Vasomedical, Inc.

Brochure entitled EECP A New Therapy For Angina Ppectoris (A Patient's Guide to Enhanced External Counterpulsation) by Vasomedical, Inc. Heartbeat, vol. 3, No. 2 p. 1–4.

* cited by examiner

*Primary Examiner*—Glenn E. Richman
(74) *Attorney, Agent, or Firm*—Gifford, Krass, Groh, Sprinkle, Anderson & Citkowski, P.C.

(57) ABSTRACT

Aerobic rhythmic running exercise (RRE) is an exercise mode wherein a horizontally disposed participant elevates and lowers his or her limbs alternately in a striding manner against dissipative loading provided by enabling RRE apparatus. RRE comprises safe aerobic exercise for cardiovascularly handicapped heart patients and other participants by substantially supporting or balancing the weight of the limb groups one against the other during the alternate limb elevation and lowering. It is an observed fact that the blood pressure remains near resting values during such aerobic RRE. It has also been observed that RRE allows an athlete to preferentially develop fast twitch muscles useful for enabling improved running speed. Stationary RRE apparatus comprises a supporting tripod structure, and pulley supported leg and arm supporting rope lines coupled to leg and arm drive belts that are, in turn, coupled to leg and arm drive sprockets. The drive sprockets are operatively coupled to either an energy dissipative hydraulic assembly or an energy dissipative electric assembly utilized for providing selected dissipative loading for motions thereof. Alternate RRE apparatus is semi-portable in nature and comprises an elevated housing and horizontal member for mounting all functional components including reel mounted leg and arm supporting rope lines and a timing belt coupled energy dissipative hydraulic assembly or energy dissipative electric assembly utilized for providing selected dissipative loading for motions thereof. The elevated housing and horizontal member are supported above the participant by assembled front and rear tripod legs.

21 Claims, 17 Drawing Sheets

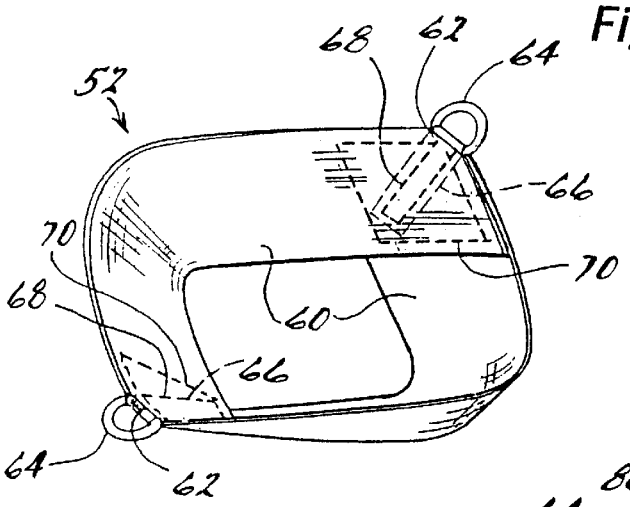
Fig. 2A
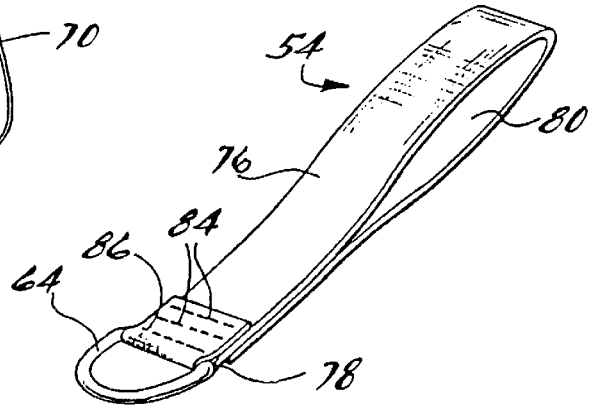
Fig. 2B
Fig. 3
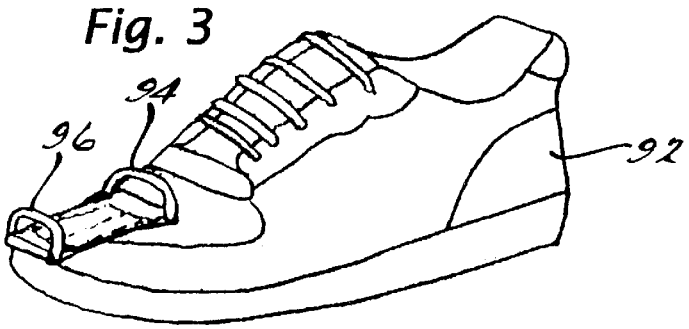
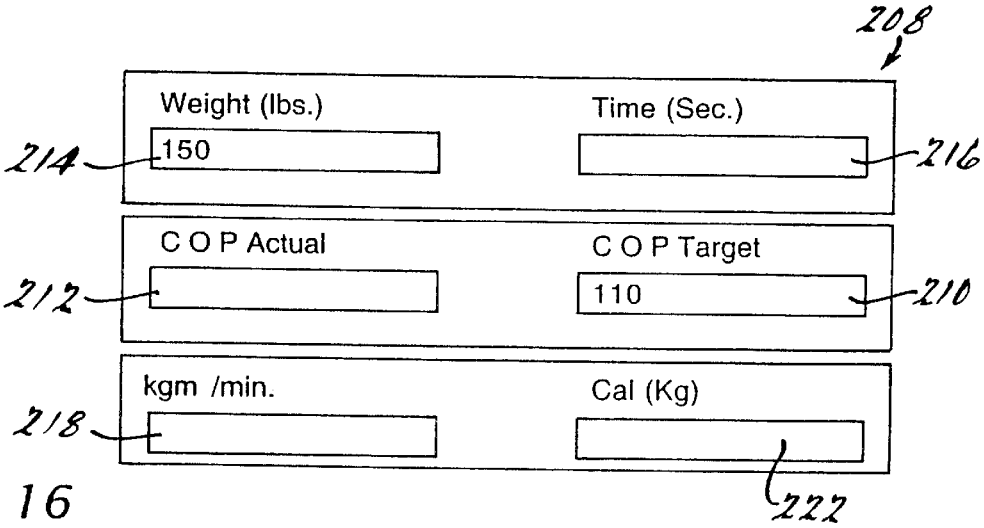
Fig. 16

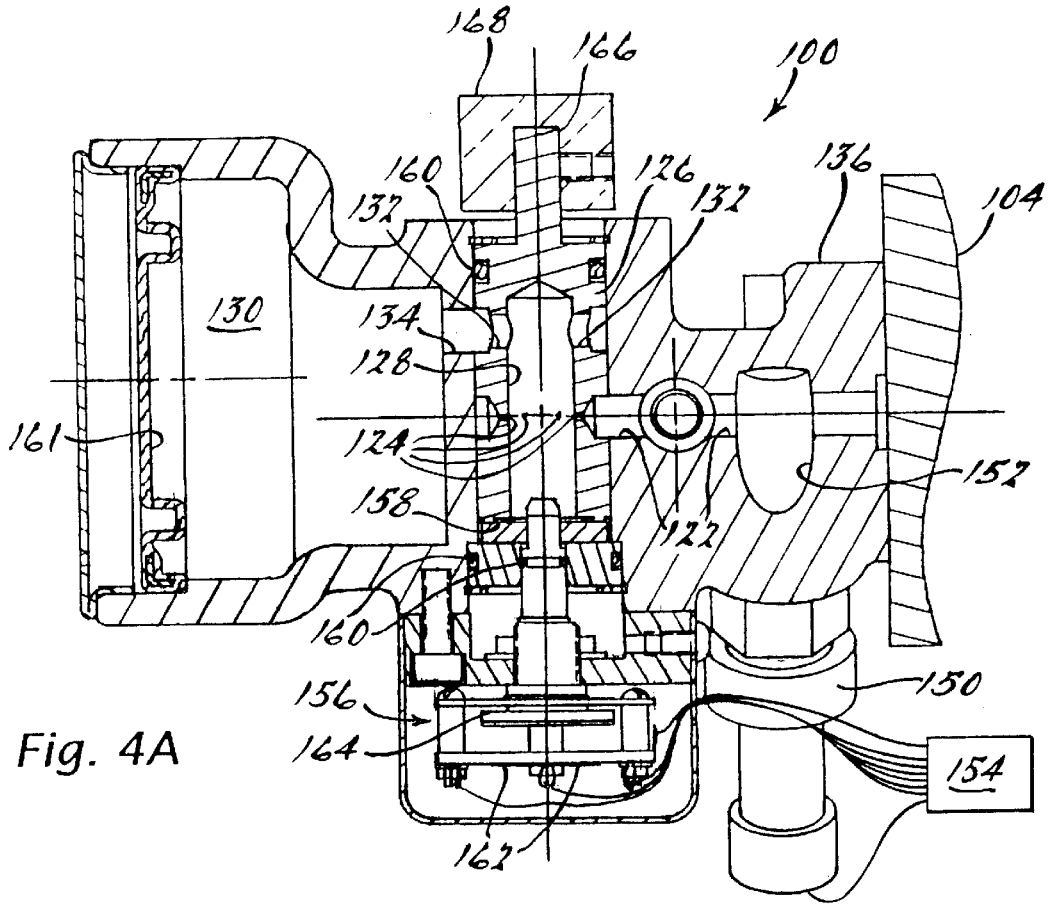
Fig. 4A
Fig. 4B
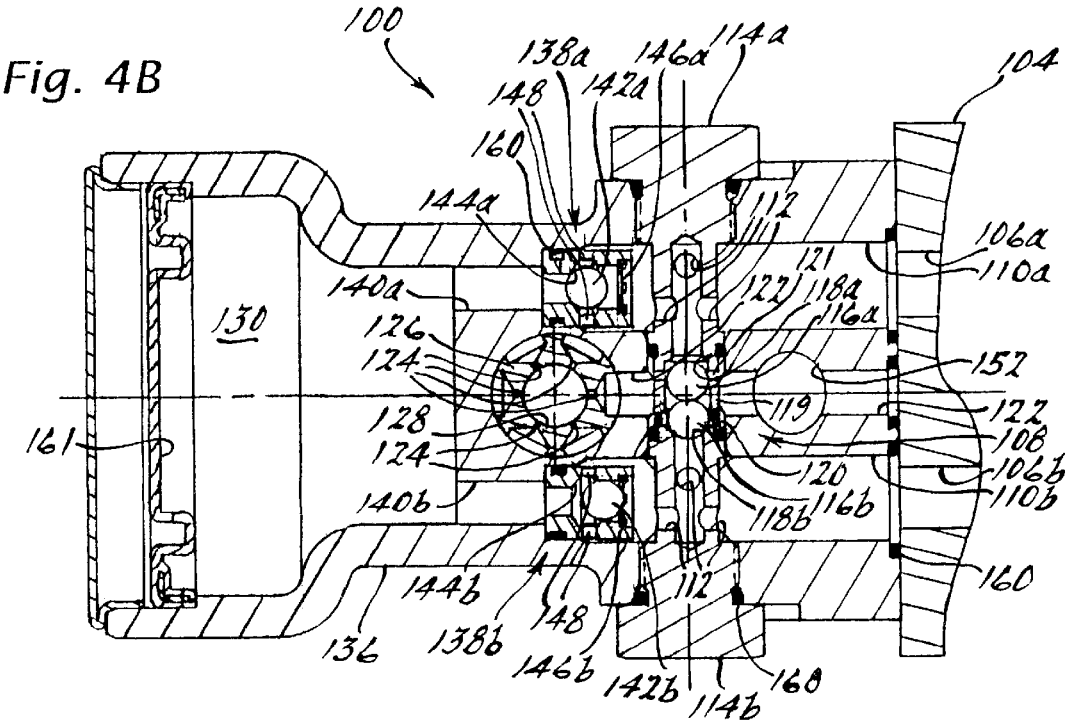

METHOD AND APPARATUS FOR ENHANCING PHYSICAL AND CARDIOVASCULAR HEALTH, AND ALSO FOR EVALUATING CARDIOVASCULAR HEALTH

CROSS-REFERENCE TO RELATED APPLICATIONS

The subject matter of the present application is largely taken from that of Provisional U.S. patent application Ser. No. 60/146,741 dated Aug. 2, 1999 and from Provisional U.S. patent application Ser. No. 60/165,756 dated Nov. 16, 1999 both entitled "Method and Apparatus for Enhancing and Evaluating Cardiovascular Health", and therefore claims priority in part from those dates. In addition, the subject matter of the present application is also related to that of U.S. patent application Ser. No. 09/174,391 dated Oct. 14, 1998, which in turn, drew priority from Provisional U.S. patent application Ser. No. 60/097,206 dated Aug. 29, 1998 and Provisional U.S. Patent Application Ser. No. 60/099,378 dated Sep. 8, 1998 all entitled "Method and Apparatus for Enhancing Cardiovascular Activity and Health Through Rhythmic Limb Elevation". Because of their precursive association with the present invention, the patent application '391 and the provisional patent applications '206, '378, '741 and '756 are expressly incorporated herein by reference.

BACKGROUND OF THE INVENTION

I. Field of the Invention

The present invention relates generally to method and apparatus for enhancing the status of physical and cardiovascular health in the human body as well as for evaluating the current status of cardiovascular health therein, and more particularly to method and apparatus for enhancing blood flow generally through the whole cardiovascular system via enabling safe and beneficial high levels of aerobic exercise for the human body, and in addition, for providing safe means for cardiovascularly stressing a heart patient while quantitatively measuring his or her physical and cardiovascular capacity.

II. Description of the Prior Art

Cardiovascular disease kills four out of ten Americans. Often cardiovascular rehabilitation is prescribed in an effort to prolong the lives of heart patients. Conventional cardiovascular rehabilitation treatment protocols generally comprise prescribed forms of nominally aerobic exercise. For instance, walking is often prescribed. This is often done on an instrumented treadmill in combination with simple health monitoring steps such as taking blood pressure both before and immediately following exercise in order to document and verify results. Such cardiovascular rehabilitation protocols often additionally comprise various forms of mild resistance training in spite of the fact that such forms of exercise are commonly observed to elevate blood pressure. Apparently this is done in the belief that such measured exposures to cardiovascular stress better prepare heart patients for the unpredictable stressful events that they will face in the future during normal conduct of their lives. In spite of that hopeful opinion as well as various studies showing somewhat longer life expectancy for so cardiovascularly stressed heart patients, it is believed herein that any form of resistance training is undesirable for heart patients. As is fully explained hereinbelow, that opinion is based upon the fact that such resistance training is conducted, at least in part, in an anaerobic manner. As will be described below, this comes about as a result of the phenomenon of blood flow through stressed muscle tissue being inhibited.

At the opposite end of the cardiovascular health spectrum, athletes are often directed to engage in high intensity forms of anaerobic exercise such as sprinting and resistance training. In these cases the various forms of high intensity anaerobic exercise are usually performed with the actual intent of "tearing down" muscle tissue. The benefits are supposed to come as a part of a rebuilding process during a day or more of recovery before the next exercise session. Weight lifting is a good example of this. However, weight lifting, and especially power lifting, is accompanied by extremely high blood pressure (i.e., with values such as 230/150 being commonplace). Even other forms of upright exercise (i.e., such as distance running) intended to be aerobic in nature, are accompanied by somewhat elevated blood pressure (i.e., with values such as 170/100 being commonplace). It is believed herein that experiencing such anaerobic exercise or elevated blood pressure values, other than on an occasional basis, is harmful to the cardiovascular system. It is further believed herein that experiencing such elevated blood pressure values while exercising is counterproductive to optimum muscle development. A basic understanding of the cardiovascular system is helpful in understanding these phenomena.

Most discussions about the cardiovascular system begin with the heart. However, other than noting that the heart comprises right and left halves respectively serving pulmonary and systemic circulation systems, it is appropriate to start with the systemic circulation system where the work of the cardiovascular system is actually accomplished. Oxygenated blood is distributed throughout the body via the arteries. The arteries are elastic tubes comprising a circumferentially stressed muscle layer. This volumetrically compliant structure allows the arterial system to act like an accumulator. The arterial system absorbs the volumetric impulses of blood generated by the heart. Then arterial compliance maintains non-zero blood pressure values between the heart's blood ejection periods. The maximum pressure value achieved during blood ejection is known as systolic blood pressure while the minimum pressure reached just prior to pumping events is known as diastolic blood pressure. This accumulator-like behavior keeps a continuing flow of blood moving in serial fashion through arterioles, capillaries and venules on its way to the venous system and eventual return to the heart. "Normal" blood pressure is considered to be something like 120[mm Hg] over 80[mm Hg].

In addition to their accumulator-like function, the arteries serve as a system of pipelines distributing oxygenated blood throughout the body and suffer little pressure drop due to blood flow. On the other hand, the blood next flows through arterioles that present the greatest resistance to blood flow and are utilized hydro-mechanically as regulators of blood flow through various portions of the body. As a result they act cumulatively as regulators of blood pressure as well. The arterioles comprise a thin muscle sheath functionally able to change arteriole diametral size over a range of about 4:1 in response to commands from cardiovascular control centers in the brain. Blood flow through the arterioles obeys laminar flow laws whereby blood flow resistance varies according to a fourth power law with reference to arteriole diametral size. Thus, blood flow resistance therethrough can be varied over a range of about 256:1.

In addition to the variable blood flow resistance of the arterioles, overall blood flow resistance is varied by the percentage of capillaries conveying blood at any given time.

Precapillary sphincter muscles guard the origin of each capillary. At rest most of the precapillary sphincter muscles are closed. During exercise, more precapillary sphincter muscles juxtaposed to working muscles become dilated in response to commands from the cardiovascular control centers in the brain and capillary blood flow increases dramatically in those areas. The blood does its basic work of exchanging oxygen and nutrients for carbon dioxide and various waste materials in the capillaries. They are quite small, averaging about 8 microns (0.0003 inch) in diameter (e.g., about one eighth the size of an average human hair). However, there are an enormous number of capillaries, perhaps as many as 2,500 per square millimeter of muscle tissue. In any case, the used blood is next collected from the capillaries by small veins called venules and conveyed to the venous system for return to the heart.

As opposed to the arteries, the veins are not simply open tubes heading back toward the heart. Rather, they are thin walled vessels many of whom comprise semilunar folds oriented in the direction of blood flow. The folds serve as check valves operating in sympathy with surrounding muscular activity. The smallest muscular contractions cause waves of vein compression. This in concert with the valves causes the veins to act as progressive pumps helping the venous blood flow back toward the heart. If a subject individual stands quite still, the venous blood pressure in the lower legs will approximate 100 [mm Hg] as opposed to about 8 [mm Hg] at the heart and about 0 [mm Hg] at the neck. As the subject individual commences walking, the venous blood pressure in the lower legs will drop to about 30 [mm Hg] because of this pumping action. Thus, blood pooling in the lower extremities is avoided and the difference between lower leg arterial and venous blood pressure increases by about 70 [mm Hg] as a consequence of the contractions of the leg muscles themselves.

All of the blood returning from the body via the venous system is conveyed to an upper right heart chamber called the right atrium. The pumping action of the venous system assists in charging the right atrium with returning venous blood. The returning venous blood stretches the muscles of the right atria. During diastole (the resting period) the lower right chamber (called the right ventricle) is "protected" from pulmonary pressure by the pulmonary valve and achieves a slightly negative pressure. As systole (e.g., the pumping action) begins, the muscles of the right atria contract and force additional blood through the right atrioventricular valve and into the still relaxed right ventricle. The incoming blood dilates the right ventricle further by stretching its muscles. As systole continues, the muscles of the right ventricle then contract closing the right atrioventricular valve and forcing the blood through the pulmonary valve into the pulmonary artery. Following systole the pulmonary valve closes and the pumping cycle of the right side of the heart is complete.

The pulmonary system functions similarly to the systemic circulation system described above in circulating blood through the lungs and back to the left atrium of the heart as oxygenated blood. The left half of the heart behaves similarly to the right half with the left ventricle being "protected" from systemic pressure by the aortic valve during diastole. Systole of both halves of the heart occurs simultaneously. And similarly at the beginning of systole, the oxygenated blood is forced through the left atrioventricular valve and into the left ventricle. As systole continues, the muscles of the left ventricle contract, forcing the oxygenated blood through the aortic valve into the aorta and on to the arterial system. Again, after the oxygenated blood has sequentially passed through these valves, pressure differences close them in turn.

Of interest is the fact that the myocardium (e.g., the heart muscle tissue) is the body's only tissue that receives its overwhelming majority of fresh blood flow during diastole. This is because blood flow through capillaries comprised in the myocardium is observed to substantially cease during systole. Apparently this comes about as a result of that muscle tissue being stressed during systole with the inference being that stressed muscle tissue constricts comprised capillaries thus substantially stopping blood flow therethrough.

The human cardiovascular system described above is subject to the same principles of hydrostatics as any other hydraulic system. Specifically, blood at the bottom of a generally vertical system of tubes such as the arterial system achieves a higher pressure than that at the top of the system of tubes. The density of blood is inversely related to the density of mercury by a factor of approximately 13.5. Thus, a nominally ideal systolic/diastolic pressure ratio of 120/80 [mm Hg] translates to a nominally ideal systolic/diastolic pressure ratio of about 1620/1080 [mm blood]. If a subject individual six feet tall is standing erect and that blood pressure reading is taken at a height of about four and a half feet from the floor, then blood pressure at the bottom of the feet must be about 2992/2452 [mm blood], or 222/182 [mm Hg] while at the top of the head about 1163/623 [mm blood], or only 86/46 [mm Hg].

In general, heart rate, dilation of the arterioles, and selective dilation of precapillary sphincter muscles is controlled by neural signals issuing from the cardiovascular control centers in the brain. The main pressure sensors feeding arterial blood pressure information to the cardiovascular control centers in the brain are two baroreceptors located respectively in the aortic arch and carotid sinus. In addition, the physical status of the left ventricle, right atrium, and large veins is conveyed to the cardiovascular control centers in the brain by mechanoreceptors associated with each. During upright exercise the status of the neural signals issuing from the cardiovascular control centers in the brain result in increased heart rate along with selective dilation of arterioles and precapillary sphincter muscles associated with the various working muscles.

During exercise, operation of the systemic circulation system as a whole, and specifically the pumping action of the exercising muscles in concert with the venous system "check valves" (e.g., in helping venous blood flow back toward the heart), results in right atria of the heart being charged to a larger extent than during resting periods. This results in larger right ventricle stroke volume, and thus in serial turn, larger left ventricle stroke volume. In general, a delicate balance between stroke volume, heart rate, and selective dilation of the arterioles and precapillary sphincter muscles regulates the blood pressure in response to control by the cardiovascular control centers in the brain. The result is the noted normal increase in blood pressure during upright exercise for most adult humans.

As mentioned above, it is believed herein that experiencing anaerobic exercise, other than on an occasional basis, is quite undesirable. This belief is herein promulgated because, by definition, anaerobic exercise comprises muscular activity conducted in the absence of free oxygen. In other words, energy conversion is required at such a rate that the cardiovascular system is unable to supply sufficient oxygen. Thus, the muscle tissue must produce mechanical energy faster than corresponding amounts of chemically produced energy can be generated from normal burning of carbohydrates. This results in destructive partial consumption of the muscle tissue itself and concomitant generation of toxins which must eventually be carried away by the blood.

Further complicating all of the above (e.g., for heart patients) is the fact that some of these toxins are generated within the myocardium. As these toxins move toward capillaries juxtaposed to the various blood vessels of the myocardium, they cause inflammation and inward swelling of tissues immediately theresurrounding according to a hypothesis known as the "halo effect". If the blood carrying capacity of those vessels is already compromised by narrowing due to plaque deposits, serious cardiovascular difficulty can result. This may, for instance, be the cause of heart attacks occurring hours, or even a day or more, after anaerobic exercise and during resting periods when the heart is otherwise free from stress.

It is believed herein that experiencing elevated blood pressure values, other than on an occasional basis, is harmful to anyone's cardiovascular system. During upright exercise the left ventricular muscle tension must rise to a higher value during the heart's isovolumetric contraction period before the aortic valve can open. Then the left ventricular muscle tension must rise to an even higher level during blood ejection. This means more heart strain. It commonly results in a generally uncomfortable feeling during such upright exercise and causes many to shun beneficial nominally aerobic exercise. More importantly, the persistent heart strain leads to thickening of the left ventricular muscle. Similarly, it leads to a general thickening of the muscle layers of the arteries and arterioles. This, in turn, presumable leads to insensitivity of the arterioles whereby they are less capable of size change and less able to control blood flow distribution and pressure. And while experiencing such elevated blood pressure values, fewer precapillary sphincter muscles are dilated whereby fewer capillaries are available to serve the surrounding muscle tissue.

As an aside, much has been made of "type A behavior" and its relation to cardiovascular disease. It is believed herein that type A behavior is actually a synonym for behavior that results in persistent higher blood pressure values. It has been found that anxiety and the kind of verbosity that typically accompanies anxiety is always accompanied by a significant rise in blood pressure. This is not to be confused with an occasional normal blood pressure reading taken during a physical exam when a subject type A individual might temporarily be in a calmer state. Rather, it is a continual tendency toward elevated blood pressure due to persistent behavior patterns. Thus, the inference is that the tendency for type A individuals to have more cardiovascular problems is simply due to their averagely higher blood pressure.

As also stated above, it is further believed herein that experiencing such elevated blood pressure values while exercising is counter-productive to optimum muscle development. This is so believed because higher blood pressure implies that fewer pre-capillary sphincter muscles are in a dilated state, and thus, fewer capillaries are in use. Thus, there is less capillary working area and averagely there is a further distance between the capillary working area and muscle tissue to be served. It follows then that the exchange of oxygen and nutrients for carbon dioxide and various waste materials is less efficient. Thus on a microscopic level anaerobic activity may be present even during aerobic exercise.

This possibility of anaerobic activity existing during generally aerobic treadmill exercise is specifically in contrast to fully aerobic exercise conducted on the apparatus of the incorporated patent application '391 and provisional patent applications '206 and '378. Specifically, those patent applications describe implementation of an exercise called rhythmic limb elevation (hereinafter referred to by the acronym RLE) wherein all four limbs are elevated and then lowered simultaneously at a relatively slow rate such as 20 cycles per minute. In addition to apparently enabling the development of collateral circulation around partial coronary artery blockages, this form of aerobic exercise has been demonstrated with blood pressure at or even below resting levels at significant applied power levels. By way of example, the inventor typically experiences blood pressure values averaging about 100/57 immediately following such RLE exercise (e.g., a value significantly less than his normal resting systolic and diastolic blood pressure value of about 120/80).

It is evident that these very low blood pressure values are enabled by the nature of the RLE exercise itself. In part, it is believed herein that this is due to the fact that during RLE exercise the limbs are averagely elevated whereby venous blood is substantially drained from the large veins of the limbs. It is believed herein that mechanoreceptors associated with the large veins of the limbs then convey signals to the cardiovascular control centers in the brain declaring that they are in a "flattened" state thus implying that inadequate venous blood is present therein. It is further believed herein that the response of the cardiovascular control centers is to command further dilation of the arterioles and open more of the pre-capillary sphincter muscles comprised in the limbs, whereby the resistance to blood flow is reduced, and as a consequence of that the blood pressure is reduced as well.

However, in addition to having the limbs averagely elevated during exercise it is also important that all exercising muscle groups are alternately stressed and then relaxed as in the general manner associated with RLE exercise. This naturally occurs during RLE exercise because the RLE apparatus is position determinant in nature whereby the exercising individual (hereinafter referred to as a "participant" of "RLE participant") can lift his or her limbs on the way up and pull downward on the way down. Thus, all of the exercising muscle groups have brief but regular periodic rest periods sometime during each exercise cycle while they are in a relaxed state. This permits blood flow through all exercising muscle tissue for at least a portion of each exercise cycle. Thus, true aerobic activity on a microscopic level occurs in each exercising muscle group during RLE exercise whereby all exercising muscle groups can achieve optimum development within the limits imposed by the format of the RLE exercise itself.

That this is an important factor can be easily verified by comparing results with other sometimes compared forms of exercise as performed on other commercial available apparatus. Two such products are the "Medisled" available from Topaz Medical, Ltd. of Colorado, and the "Clinical Reformer" available from Balanced Body of Sacramento, Calif. Both of these products comprise horizontally moving sleds upon which a patient lies and drives him- or herself and the sled in an oscillatory manner against elastic bands using leg power. Because the use of both of these products entails continuous stress of one set of leg and hip flexor muscles while the complementary set of leg and hip flexor muscles remains totally unstressed, the use of these products can be said to be a form of resistance training. The common result is that any extended use of these products generates a "muscle burn" and blood pressure values are elevated with reference to either of RLE exercise or the related exercise on apparatus of the present invention to be discussed below. Because of these factors it is not believed herein to be safe or even possible to engage in exercise at continuous high levels of applied power such as is described hereinbelow on either of the "Medisled" or "Clinical Reformer".

It is believed herein that the reason for this is the above cited fact that stressed muscle tissue constricts comprised capillaries thus substantially reducing blood flow therethrough. Since that blood flow is substantially curtailed, the muscle tissue itself must generate its own energy source for sustaining the exercise. The result is muscle decomposition, or "tear down" and the noted muscle burn or soreness. It is further believed herein that the brain's cardiovascular control centers concomitantly raise blood pressure by closing down arterioles juxtaposed to unstressed muscle tissue. This is done in an effort to force blood through the substantially constricted capillaries of the stressed muscle tissue.

However, with reference to the methods and apparatus of either the above described products or of the present invention, the principle value of RLE exercise is its apparent ability to enable formation of collateral circulation around partial coronary artery blockages. Although it is certainly possible to attain higher levels of continuous applied power during RLE exercise than on either of the two competing products described above, RLE alone has not been found to enable desired really high levels of applied power and thus optimum physical and cardiovascular development. In part this because of the relatively slow cyclic rate at which RLE is conducted whereby applied power levels are somewhat limited. Further, training of some of the muscle groups utilized in running tends to be limited because of the physical nature of the synchronous limb elevation utilized in RLE. Thus, it would be desirable to extend the optimum exercise philosophy of RLE to a complementary exercise that characteristically enables even higher applied power levels and more completely trains the majority of muscle groups utilized in running. Specifically in this regard, a higher level of training for the hamstring and gluteus muscle groups would be desirable.

Therefore, it is a general object of the present invention to provide improved method and apparatus for enabling exercise at high applied power levels, and further, for providing enhanced training for the hamstring and gluteus muscle groups, even while exercising aerobically and maintaining blood pressure levels at or near normal resting values.

In totally another vein, "stress tests" are routinely conducted for the purpose of uncovering ischemia at high pulse rate values. Such stress tests necessarily comprise quantitative measurement of a heart patient's cardiovascular capacity. In the United States this is typically accomplished via heart patients being electrocardiographically monitored while they walk on suitably controlled treadmill apparatus. During a stress test, a heart patient progresses through successive three minute long stages of aerobic and anaerobic exercise comprising increasing values of treadmill incline and speed until the heart patient reaches a target pulse rate, or otherwise, until ischemia is observed. Whenever either event occurs, the stress test is terminated and the electrocardiographical data is evaluated.

The successive stages of treadmill operation typically include a 10% grade and 1.7 mph speed during stage 1, a 12% grade and 2.5 mph speed during stage 2, a 14% grade and 3.4 mph speed during stage 3, a 16% grade and 4.2 mph speed during stage 4, an 18% grade and 5.0 mph speed during stage 5, and a 20% grade and 5.5 mph speed during stage 6. Taking a stress test is quite a strenuous undertaking for any heart patient wherein the concluding phases of that stress test are indeed anaerobic in nature. In terms of being hazardous to a heart patient (especially with reference to the halo effect mentioned above), such a test can easily emulate normally discouraged activities such as shoveling snow.

Relatively few heart patients are able to progress through stage 4. This fact is readily substantiated by understanding the amounts of net power that must be applied to the belt of the treadmill by a heart patient during the various stages. For instance, an individual weighing 175 lbs. would respectively apply power to the belt of the treadmill at levels of 0.079, 0.139, 0.220, 0.310, 0.413 and 0.503 horsepower while climbing up the various grades and at the speeds listed while executing stages 1 through 6.

In order to minimize the strenuous nature of these tests, it would be desirable to utilize a mode of exercise that would allow heart patients to generate similar applied power levels and appropriate pulse rates, but do it at generally lower blood pressure values. This should be sufficient to equivalently show ischemia. However, the effect on the heart patient should be gentler than when achieved during a traditional stress test. It is therefore yet another object of this invention to present improved method and apparatus for conducting stress tests at generally lower blood pressure values.

In order to enable such testing, it is necessary to enable measurement of the heart patient's power output as well as the total amount of energy he or she applies to the test apparatus. Actually, it would be desirable to present such data to anyone exercising on such apparatus—at least as an available option. For one thing, it would be expected because anyone who has used a commercially available treadmill thinks that they have seen similar data before. However, even though such machines usually indicate Calories consumed per session, that data is merely placebo information because it bears no relationship to actual work done by the individual exercising on the treadmill. Rather, it is merely a calculated number supposedly representative of the energy an average individual would consume while exercising on such a machine over any particular exercise period. This fact can easily be demonstrated by simply turning a treadmill on and watching its display. The indication of Calories consumed will increase just as though someone was walking on the machine! Thus, it is another object of this invention to present apparatus for measuring applied power and energy per exercise session as actually applied to the apparatus of the present invention.

In addition to the power applied to the belt during stress tests, a heart patient being tested on a treadmill also has to generate the internal power required for generating his or her leg motion. This introduces yet another undesirable variable into present stress testing because different individuals have differing terminal walking speeds whereby many must break into a running mode during their final stress test stage. Since running implies a different required level of internal power generation, it is difficult to standardize test results among heart patients having differing physiques or natural athletic abilities. Thus, it is yet another object of this invention to present a method for enabling more uniform quantitative measurement of the cardiovascular capacity of heart patients.

SUMMARY OF THE INVENTION

These and other objects are achieved in method and apparatus for enhancing physical and cardiovascular function, in which operation in a preferred exercise mode wherein the torso is horizontally disposed and first and second limb groups respectively comprising the left leg and right arm, and the right leg and left arm, are alternately raised and then lowered. The preferred exercise mode is called Rhythmic Running Exercise and is hereinafter referred to by the acronym RRE. It can be utilized for enabling exercise at high applied power levels and can provide enhanced training for the hamstring and gluteus muscle groups, even while exercising aerobically and maintaining blood pressure levels near normal resting values. As a result, cardiovascular function is improved on a minute level thus enabling more effective muscle development (e.g., especially with reference to any form of standard "upright" exercise).

Hereinafter this combination of RRE and aerobic physical exercise will be referred to as "aerobic RRE" and the apparatus of the present invention will be referred to as "RRE apparatus". Similarly to RLE, anyone exercising in the RRE mode will be referred to as a "participant" or "RRE participant". RRE apparatus comprises means for nominally supporting or balancing the weight of the limbs one against the other during RRE and also comprises means for dissipating power applied to the RRE apparatus by a participant in the form of heat. These factors result in a participant being able to apply upward force during limb elevation and then exert downward force while subsequently depressing the limbs. The resistance to limb motion is variably selectable thus allowing a participant to perform aerobic RRE at intensity levels beginning at even less than the minimum level required for walking. At the opposite level of the fitness, precisely the same apparatus can be utilized by a highly trained athlete to enhance his or her cardiovascular capability and muscular development.

Further, aerobic RRE is performed with the heart at the lowest possible elevation whereat it is subject to increased venous blood pressure at the entrances to the right atria thus increasing expansion thereof during each heart cycle. This results in increased blood flow volume during each heart stroke and substantially lower pulse rates. And as implied above, it is an observed fact that elevated blood pressure values are avoided during aerobic RRE. This is deemed beneficial for all of the reasons described above. Specifically, it is believed herein that more pre-capillary sphincter muscles located within exercising muscle tissue are open, and therefore, that more capillaries are in use. Thus, there is more capillary working area and averagely less distance between the capillary working area and muscle tissue. It follows that the exchange of oxygen and nutrients for carbon dioxide and various waste materials is more efficient. Thus, it is believed herein that superior muscle development commonly observed in connection with aerobic RRE is a direct result of the lowered blood pressure levels achieved during aerobic RRE.

It has been found that individuals unable to walk aerobically without suffering unpleasant cardiovascular symptoms can easily begin an aerobic RRE program. It has been found that blood pressure values and pulse rates are minimally elevated while performing beginning intensity level aerobic RRE. Further, once a beginning intensity level of performance is achieved, intensity levels can gradually be increased in order to achieve improving levels of cardiovascular fitness. It is believed herein that performing aerobic RRE at ever increasing intensity levels rejuvenates and enhances cardiovascular activity and health.

At the opposite extreme of perceived physical fitness, supposedly well conditioned athletes (i.e., football players) can also benefit from aerobic RRE. This is because their normal exercise programs are almost exclusively anaerobic in nature. Aerobic RRE is helpful in aiding recovery from such anaerobic exercise. Further, aerobic RRE tends to preferentially develop muscles useful for running—specifically the hamstring and gluteus muscle groups. Still further, RRE will hopefully result in the reduction of commonly practiced gross consumption of "muscle building" food additives and widely reported "underground" use of anabolic steroids and other drugs to aid in recovery from weight training sessions and otherwise stimulate muscle growth. The overall effect of such extreme levels of consumption excess and anaerobic exercise is especially apparent in the case of linemen who seem to be approaching Sumo wrestler-like physical proportions. It is apparent that many of these individuals have sacrificed almost everything in an effort to "bulk up". It is also a fact that many have real difficulty in playing through an entire football game without approaching a state of exhaustion.

It has been found that aerobic RRE can be of considerable benefit to anyone. If carried to an advanced state, aerobic RRE results in burning Calories, and especially "fat Calories", at a high rate. When used in this sense, the term Calorie actually refers to a Kilogram Calorie, or the amount of energy required to heat one Kilogram of water one degree Centigrade. The term "fat Calories" refers to that portion of the Calories burned that actually consumes body fat. It is apparently a fact that only slow aerobic exercise (e.g., as particularly opposed to anaerobic exercise) will result in burning of fat Calories. In addition to consumption of unhealthy body fat (i.e., especially "high torso fat" present upon and within many middle aged and older men), it has been found that aerobic RRE results in significantly improved muscle tone and mass. Further, athletic performance levels as well as cardiovascular capability can markedly increase.

In a related example, the inventor was a 66 year old male weighing 190 pounds who, just prior to his developing the companion RLE exercise method and enabling apparatus, was only able to get through the tenth minute of stage 4 of a stress test before showing signs of ischemia and through the twelfth minute before reaching his target pulse rate of 155. This was followed by physical exhaustion and at least two days of noticeable angina pain. After 6 months of aerobic RLE exercise he was able to get completely through the fifteenth minute of stage 5 of a succeeding stress test at just under his target pulse rate of 155 per minute (e.g., at 154 per minute). No ischemia was observed during the stress test and there were no angina pains present following that test. While it is believed herein that this improved cardiovascular performance was principally enabled by formation of collateral circulation around partial coronary artery blockages, it was also enabled in part by his new found ability of easily being able to walk at 5 mph. His muscular co-ordination and flexibility development after 6 months of aerobic RLE exercise were such that he could even walk up such a grade at 6 mph. Later, after a few more months of aerobic RLE exercise and just after his $67^{th}$ birthday, he was able to increase his maximum walking speed to 7 mph. Then still later after developing the RRE method and enabling apparatus of the present invention, he was able to walk at a speed of 8.1 mph (e.g., 13.0 Km./hr.). These performance levels were attained even though walking at over 5 mph had been a physically impossible task for him before the development program began.

However, overcoming the effects of the relatively severe anaerobically generated oxygen debt engendered by the above described stress test did require a significant recovery period and set back his RLE conditioning program over a week. This effect is more fully discussed below because it has served as an impetus for development of a new and improved cardiovascular stress testing procedure. The improved cardiovascular stress testing procedure utilizes a supplemental function of the apparatus of the present invention wherein performance measurements, including running values of applied power and energy delivered by a participant, are continually made and presented. It is believed herein that the improved cardiovascular testing procedure will enable safer and more uniform quantitative measurement of the cardiovascular and exercise capacity of heart patients.

According to a preferred embodiment of the present invention, practical implementation of the RRE method can be realized by utilizing RRE apparatus comprising an energy dissipative hydraulic assembly for dissipating participant applied power as heat. The energy dissipation is a result of energy loss associated with fluid flow through a selected orifice as provided by a bi-directionally driven reversible gear pump. The reversible gear pump is driven bi-directionally via a drive belt assembly (e.g., by the participant via alternate limb group elevation and lowering in the manner of striding or running). The energy dissipative hydraulic assembly and the drive belt assembly are mounted upon a central leg of a tripod structure. Suitable gear pumps for use in the energy dissipative hydraulic assembly are manufactured by Barnes Corp. of Rockford, Ill. under the general model designation "GC Pumps".

The participant's first and second limb groups are separately coupled to either side of dual timing belts comprised in the drive belt assembly via supporting means formed in a manner to be described below. The dual timing belts are coupled to one another and the reversible gear pump via a compound drive sprocket assembly comprising leg and arm drive sprockets. Forces required for nominally supporting or balancing the weight of either limb group against the other is provided via straps supporting one limb group, a corresponding pair of rope lines, the combination of the dual timing belts and the compound drive sprocket assembly, the opposing pair of rope lines, and the opposing straps. Because the participant's legs naturally generate longer stroke lengths than his or her arms, the drive sprocket utilized in conjunction with the legs has more teeth than the other drive sprocket used in conjunction with the arms whereby the rope lines supporting the legs move further than those supporting the arms.

The energy dissipative hydraulic assembly also comprises a sub-system for directing pressurized fluid flow from an instant output port of the reversible gear pump through the selected orifice, which orifice is actually a selected one of a set of interchangeable orifices. In the sub-system, flow of pressurized fluid is directed from either port of the reversible gear pump through the selected orifice to a reservoir via a three-way check valve assembly. Concomitantly, a corresponding other one of two two-way check valve assemblies directs an equal flow of fluid from the reservoir into the other, or instant input port of the reversible gear pump.

According to a first alternate preferred embodiment of the present invention, practical implementation of the RRE method can also be realized by utilizing alternate RRE apparatus comprising a somewhat modified energy dissipative hydraulic assembly for dissipating applied power as heat. The energy dissipation is a result of energy loss associated with fluid flow from either port of the reversible gear pump directly through a corresponding one of selected identical ones of two sets of interchangeable orifices to a common passage, and then the partially spent fluid is at least partially conveyed therethrough to a reservoir. That amount of fluid flow is returned to the other, or instant input port of the reversible gear pump via a corresponding other one of two two-way check valve assemblies with the remainder of the fluid flow being directly returned thereto via the other of the selected identical ones of the two sets of interchangeable orifices. Alternately, a return orifice may be utilized for partially conveying the partially spent fluid to the reservoir. As described below, this allows for optional measurement of the flow rate of the fluid conveyed to the reservoir and then calculation of the instant value of applied power.

As optional features of the preferred and first alternate preferred embodiments then, participant applied power (e.g., to RRE apparatus of either the preferred or first alternate preferred embodiments) values can be determined via either pressure or temperature measurements. For instance, a pressure transducer can be used to measure instant pressure values associated with the pressurized fluid flowing through either the three-way check valve assembly (e.g., in the RRE apparatus of the preferred embodiment) or the return orifice (e.g., in the RRE apparatus of the first alternate preferred embodiment) in order to calculate instant applied power values according to algorithms presented below. In the RRE apparatus of the preferred embodiment, a pressure transducer directly measures pump output pressure, while in the RRE apparatus of the first alternate preferred embodiment, a pressure transducer measures pressure at the return orifice.

Alternately, temperature transducers can be used to measure energy dissipative hydraulic assembly and ambient temperatures. Then energy dissipative hydraulic assembly temperature rate of change and energy dissipative hydraulic assembly—ambient temperature difference values can be generated and utilized to calculate instant applied power values according to another algorithm presented below.

RRE apparatus hopefully having lower manufacturing cost is configured according to a second alternate preferred embodiment of the present invention wherein an energy dissipative electric assembly comprising generating apparatus such as an automotive alternator and a resistor bank is substituted for energy dissipative hydraulic assemblies utilized in the preferred and first alternate preferred embodiments whereby applied power can be determined according to yet another algorithm presented below. In this application an automotive alternator is preferred because of the low cost associated with large production volumes associated therewith.

Semi-portable RRE apparatus is configured according to a third alternate preferred embodiment of the present invention wherein leg and arm supporting rope lines are directly coiled on two leg supporting reels and two arm supporting reels, respectively. The leg and arm supporting reels are of differing size in order to accommodate the differing leg and arm stroke lengths. The reels are commonly mounted upon a single shaft optionally coupled to any of the energy dissipative hydraulic or electric assemblies as configured in the manners described above. In this case however, the reels and energy dissipative assembly are mounted in an elevated housing that is supported above the participant via assembled tripod legs. The reels are located such that the leg supporting reels are nominally within the plane of motion of the leg attachment points and the leg supporting rope lines are coupled thereto with minimal fixed pulley support. Concomitantly, the arm supporting rope lines are routed via pulleys to a point above the arm attachment points for optimal coupling thereto.

In order to actually support the limbs in any of the RRE apparatus, leg and arm supporting means are attached to downward extending ends of four rope lines. The four rope lines are routed for attachment to the drive belt assembly via supporting pulleys. The supporting pulleys utilized for rigging the rope lines are similar to those commonly used in sail boats. The supporting pulleys are configured similarly to "Small Boat Blocks" available from the Harken Company of Pewaukee, Wis. In this case however, an industrial ball bearing is substituted for their normally comprised double rows of all weather plastic ball bearings in order to withstand the continuous operation of the RRE implementing apparatus of the present invention.

The participant's legs can either be supported by supporting straps formed in the manner of two-branched slings within which the feet and ankles are supported, or alternately, by shoes modified with attachment rings. The arms are supported by supporting straps formed in the manner of miniaturized automotive or public transit pull straps. Then the participant simply hooks his or her fingers through the downward extending strap loops for arm support. Spring hooks are utilized for attaching the rope lines to the leg and arm supporting means.

As the beginning participant performs aerobic RRE he or she rhythmically elevates and lowers the limbs in a comfortable manner at nominal stroke and pace. As the participant becomes experienced, he or she can increase exercise time and/or stroke and pace in order to increase applied power and total applied energy values. The participant can select a suitable resistive mechanical impedance load level as well. When the energy dissipative hydraulic assembly described in connection with the preferred embodiment is utilized this can be effected by selecting one of six orifice sizes, while in the case of the energy dissipative hydraulic assembly described in connection with the first alternate preferred embodiment it can be effected by selecting identical ones of two sets of six orifice sizes, and in the case of the energy dissipative electric assembly described in connection with the second alternate preferred embodiment it can be effected by varying field strength in the alternator. Any of these selections can be utilized to further increase the applied force values.

In the case of an athlete interested in improving his or her running skills, it is possible to attain high applied power and energy levels. This is because the alternating elevation and lowering of the limbs results in a condition of dynamic balance that makes a long leg stroke and fast repetition rate (i.e., perhaps as fast as 120 strides per minute) possible. In order to realize the full benefit of RRE through longer leg and arm strokes, the participant's torso is supported on a short, narrow padded table such as a weight lifting bench. This allows the limbs to be worked both above and below the plane of the torso.

RRE has been found to be protective against leg strain and pulled hamstring muscles in succeeding track workouts and races. Again, this is thought to be so because of the observed low blood pressure (e.g., implying more efficient capillary utilization) during RRE. It has even been observed that working the hamstring muscles in this way is helpful in overcoming the effects of a previously pulled hamstring muscle. In running, the hamstring must be protected from loading associated with stopping forward progress of the lower leg just prior to planting of the foot. In fact, during sprinting, the required deceleration is many g's in magnitude. In any case, it is thought that working the hamstring muscle under conditions of increased and more proximate blood flow in the RRE manner helps to avoid the formation of internal scar tissue at a muscle tear and promotes healing generally.

Having substantiated the desirability of so enhancing physical activity and cardiovascular health of a participant, the present invention is principally directed providing a method therefore as follows: The method includes positioning the participant under RRE apparatus comprising supporting rope lines, a drive assembly or drive belt assembly and an energy dissipative assembly; coupling the participant's limb groups to the rope lines; supporting or balancing the weight of the limb groups one against the other via oppositely coupling the rope lines to the drive assembly or drive belt assembly; coupling the drive assembly or drive belt assembly to the energy dissipative assembly; drivingly elevating and lowering the limb groups in an alternate manner against a resistive mechanical impedance load presented by the energy dissipative assembly thereby applying power thereto; and dissipating the applied power as heat.

In a first aspect, then, the present invention is directed to RRE apparatus, comprising: pulley supported rope lines coupled to each extremity of first and second limb groups of a participant; a drive assembly coupled to the rope lines; an energy dissipative assembly coupled to the drive assembly; and a combining and supporting structure; the combination for nominally supporting or balancing the weight of the participant's limb groups one against the other and dissipating power applied by the participant while he or she periodically elevates and lowers the limb groups in an alternate rhythmic manner.

In a second aspect, the present invention is directed to a particular combination of the elements identified above. More particularly, in this second aspect, the present invention is directed to RRE apparatus utilizing energy dissipative hydraulic apparatus, comprising: pulley supported rope lines respectively coupled to each extremity of first and second limb groups of a participant; a drive assembly coupled to the rope lines; a reversible pump coupled to the drive assembly and having first and second ports also coupled to the drive assembly for receiving power applied to the rope lines by the participant and generating a flow of pressurized fluid in response thereto, either one of the first and second pump ports delivering the flow of pressurized fluid and the other one receiving a similar flow of fluid depending upon the direction of rotational motion thereof; a selected orifice; a fluid reservoir; a valve assembly for directing pressurized fluid delivered from either of the first or second pump ports to and through the selected orifice to the reservoir; first and second check valve assemblies respectively fluidly coupled between the reservoir and the first and second pump ports for returning the similar flow of fluid from the reservoir to the fluid receiving one of the first and second pump ports; and a combining and supporting structure; the combination for nominally supporting or balancing the weight of the participant's limb groups one against the other and dissipating power applied by the participant while he or she periodically elevates and lowers the limb groups alternately in an alternate rhythmic manner.

In a third aspect, the present invention is directed to a particular combination of the elements identified above. More particularly, in this third aspect, the present invention is directed to RRE apparatus utilizing energy dissipative hydraulic apparatus, comprising: pulley supported rope lines respectively coupled to each extremity of first and second limb groups of a participant; a drive assembly coupled to the rope lines; a reversible pump coupled to the drive assembly and having first and second ports also coupled to the drive assembly for receiving power applied to the rope lines by the participant and generating a flow of pressurized fluid in response thereto, either one of the first and second pump ports delivering the flow of pressurized fluid and the other one receiving a similar flow of fluid depending upon the direction of rotational motion thereof; substantially identical first and second selected orifices, each respectively fluidly coupled to the pump ports for receiving the flow of pressurized fluid from either of the first and second pump ports; a fluid reservoir; a common passage fluidly coupled between the first and second orifices and the fluid reservoir for receiving the flow of fluid from either of the first and second selected orifices as partially spent fluid and delivering at least a portion thereof to the fluid reservoir; first and second check valve assemblies respectively coupled between the reservoir and first and second pump ports for returning a similar flow of fluid from the reservoir to the fluid receiving one of the first and second pump ports; and a combining and supporting structure; the combination for nominally supporting or balancing the weight of the participant's limb groups one against the other and dissipating power applied by the participant while he or she periodically elevates and lowers the limb groups in an alternate rhythmic manner.

In a fourth aspect, the present invention is directed to a particular combination of the elements identified above. More particularly, in this fourth aspect, the present invention is directed to RRE apparatus utilizing energy dissipative electric apparatus, comprising: pulley supported rope lines respectively coupled to each extremity of first and second limb groups of a participant; a drive assembly coupled to the rope lines, electrical generating apparatus coupled to the drive assembly for receiving power applied to the rope lines by the participant and generating a flow of electrical current in response thereto; a resistor bank for receiving the flow of electrical current; and a combining and supporting structure; the combination for nominally supporting or balancing the weight of the participant's limb groups one against the other and dissipating power applied by the participant while he or she periodically elevates and lowers the limb groups in an alternate rhythmic manner.

In a fifth aspect, the present invention is directed to a particular combination of the elements identified above. More particularly, in this fifth aspect, the present invention is directed to semi-portable RRE apparatus, comprising: pulley supported rope lines respectively coupled to each extremity of first and second limb groups of a participant; a hub; respective leg and arm supporting reels coupled to the rope lines and commonly mounted upon the hub; an energy dissipative assembly for receiving and dissipating power applied to the rope lines by the RRE participant; power transmission means for drivingly coupling the hub to the energy dissipative assembly; and an elevated housing supported above the participant via a horizontal member and tripod legs for commonly mounting the hub, leg and arm supporting reels, energy dissipative assembly and other functional components in a compact manner; the combination for nominally supporting or balancing the weight of the participant's limb groups one against the other and dissipating power applied by the participant while he or she periodically elevates and lowers the limb groups in an alternate rhythmic manner.

In a sixth aspect, the present invention is directed to a method for enhancing physical activity and cardiovascular health of a horizontally disposed participant wherefor RRE apparatus comprising supporting rope lines, a drive assembly and an energy dissipative assembly is provided and wherein the method comprises the steps of: positioning the participant under the RRE apparatus in a horizontally disposed manner; coupling the participant's limb groups to the rope lines; supporting or balancing the weight of the limb groups one against the other via respectively coupling the rope lines to opposite sides of the drive assembly; coupling the drive assembly to the energy dissipative assembly; drivingly elevating and lowering the limb groups in an alternate manner against a resistive mechanical impedance load presented by the energy dissipative assembly thereby applying power thereto; and dissipating the applied power as heat.

Having already established the benefits of aerobic RRE in a qualitative manner, it is further desirable to quantitatively measure the magnitude of power and energy per session applied by a participant on the various RRE apparatus. By way of example, the inventor is a six foot tall man who utilizes a 54 inch leg and 42.5 inch arm stroke at a rate of 40 up, and 40 down, strokes per minute of each limb group (e.g., 80 strides per minute) during RRE. On average, he can lift about 8 [lbs.] with each leg and 1.5 [lbs.] with each arm. He is somewhat stronger in the downward direction and can depress about 12 [lbs.] with each leg and 3 [lbs.] with each arm. This amounts to some 212 [ft.lbs.] of energy per round trip of both limb groups. At the 40 round trip per minute rate this means that he continuously applies power at an average of 8,475 [ft.lbs/min.] or 0.257 [horsepower] to an RRE apparatus that he typically uses four or five times per week. At his present weight of 175 pounds, this is somewhat in excess of the power he would apply to a treadmill during stage 3 of a stress test. The difference is that he typically delivers that power aerobically to that RRE apparatus for about 30 continuous minutes. Thus, his total energy delivery to that RRE apparatus is about 254,250 [ft.lbs.] or about 63.5 [Calories] each exercise session. Again at his present weight of 175 pounds, this is equivalent to climbing about 1452 vertical feet, or about the height of the Sears Tower in Chicago in 30 minutes. Anyway, assuming his energy conversion efficiency to be about 15%, this means that he typically burns about 423 [Calories] of carbohydrate and fat derived energy each exercise session four or five times per week.

Because it would be desirable to provide a true quantitative measurement of applied power and total energy per exercise session, methods for presenting data relating thereto are provided for use in conjunction with any of the RRE apparatus of the present invention. Specifically, in the case of RRE apparatus utilizing energy dissipative hydraulic apparatus, values of applied power can be determined in a controller via algorithmic manipulation of signals indicative of either pressure or temperature measurements. As described above, a pressure transducer can be used to measure and provide a signal indicative of a fairly high valued pressure drop (i.e., many 100's of psi) across a selected one of the single set of orifices in the RRE apparatus of the preferred embodiment, or alternately of a fairly low valued pressure drop (i.e., a few 10's of psi) across the return orifice when utilized in the RRE apparatus of the first alternate preferred embodiment. The following formulas are respectively used in conjunction therewith to calculate instant applied power values. The power applied to RRE apparatus of the preferred embodiment then is calculated according to:

$$Pwr=C_dA(2/\rho)^{0.5}(P)^{1.5} \quad (1)$$

where Pwr is an instant value of applied power, $C_d$ is the operative flow coefficient, A is the area of the fluid conveying one of the set of orifices, P is the pressure generated by the gear pump as measured by a pressure transducer, and $\rho$ is fluid density, wherein the formula has been derived from the product of the equation for flow rate through an orifice and the pressure drop across that orifice; while the power applied to the RRE apparatus of the first alternate preferred embodiment is calculated according to:

$$Pwr=C_d((2A_o^3+2A_o^2A_r+A_oA_r^2+A_r^3)/A_o^2)(2/\rho)^{1/2}(P_t)^{3/2} \quad (2)$$

where Pwr is again an instant value of applied power, $C_d$ is the operative flow coefficient, $A_o$ is the area of either of the selected fluid conveying ones of the two sets of orifices, $A_r$ is the area of the return orifice, ρ is fluid density, and $P_t$ is the pressure actually measured by a pressure transducer, wherein the formula has generally been derived from the product of the equation for flow rate through orifices and the pressure drop across those orifices but is more complex as a result of the combined flows through those various orifices.

Of course, in order to implement equations (1) and (2) above for RRE apparatus utilizing a pressure transducer, the selected orifice or orifices must be identified to the controller. Then the controller determines the values for A, or $A_o$ and $A_r$ according to information stored in a lookup table.

Alternately, energy dissipative hydraulic assembly temperature rate of change and energy dissipative hydraulic assembly—ambient temperature difference values can be generated and utilized to calculate running applied power values according to:

$$Pwr=K_1dT_o/dt+K_2(T_o-T_a)+K_3(T_o^4-T_a^4) \quad (3)$$

where Pwr is a value of applied power, $K_1$ is a first constant relating to transient heating to be determined by calibration procedures, $dT_o$ dt is the energy dissipative hydraulic assembly temperature rate of change, $K_2$ is a second constant relating to heat transfer via conduction and convection to be determined by calibration procedures, $(T_o-T_a)$ is the temperature difference, $K_3$ is a third constant relating to heat transfer via radiation also to be determined by calibration procedures, and $(T_o^4-T_a^4)$ is the difference in the temperatures each raised to the fourth power, wherein $K_3$ typically has such a small value that the third term can almost be discounted entirely. And of course, the applied power value is multiplied by a constant suitable for conversion into any desirable units such as Kilogram-Meters/minute for power.

In the case of RRE apparatus configured according to the second alternate preferred embodiment (e.g., RRE apparatus utilizing energy dissipative electric apparatus), instant values of applied power are determined in a controller according to the instant squared value of voltage delivered to a resistor bank divided by the resistance value of the resistor bank according to the following formula:

$$Pwr=V^2/R \quad (4)$$

where Pwr is an instant value of applied power, V is the voltage delivered to the resistor bank, and R is the resistance value for the resistor bank.

In controller apparatus utilized with RRE apparatus of the present invention other than with RRE apparatus using the alternate temperature based power measuring technique, a running average value of applied power is obtained by a sampling technique wherein N samples of instant applied power values are summed over N time units and then divided by the number N. As time progresses, the oldest sample is eliminated from the sum concomitantly with the addition of the most recent sample. Thus, varying instant applied power signals are processed via techniques of integration in order to provide a stable applied power signal. In the RRE apparatus using the alternate temperature based power measuring technique, such integration techniques are automatically obtained because of the relatively slow changes associated with the temperature measurements themselves. And of course, the applied power value is again multiplied by a constant suitable for conversion into any desirable units such as Kilogram-Meters/minute for power.

In all cases, after each sequential increment of time either defined by a passage of N time units (hereinafter an "N time block") or a similarly valued time increment of in the case of RRE apparatus using the alternate temperature based power measuring technique, the applied power value at the end of that N time block is multiplied by that increment of time to determine a value of applied energy for that particular N time block. Then a running sum of the applied energy values is formed in order to determine a running value of energy applied to the machine for the session. Again, running applied energy values are multiplied by a constant suitable for conversion into any desirable units such as Calories for energy.

In forming the set of orifices utilized for an energy dissipative hydraulic assembly comprising one set of orifices, a circumferential row of six orifices is radially located in a valve spool formed in a cylindrical manner around a bore therein that is fluidly in communication with the reservoir. The selected orifice is determined via rotative alignment of the valve spool in one of six available positions. In each of these positions one orifice of the circumferential row of six orifices is in alignment with a pump port leading to the gear pump. In addition, the valve spool is drivingly engaged with an electronic rotary switch having six contacts and corresponding detent positions also located at 60 degree intervals. The switch detent controls stopping locations for the rotary switch's electrical contacts and the valve spool as well. The electrical contacts are utilized to convey orifice selection information to the controller. Concomitantly, a pressure transducer is utilized to convey a signal representative of instant pressure values across the fluid conveying one of the orifices to the controller. Then the controller is able to determine the applied power and energy values according to equation (1) via the power and energy computation methods presented above.

In forming the sets of orifices utilized for an energy dissipative hydraulic assembly comprising two sets of orifices, first and second circumferential rows of six orifices each are radially located in a valve spool formed in a cylindrical manner around a bore therein that is fluidly in communication with the return orifice and therethrough to the reservoir. Again, the selected orifices are determined via rotative alignment of the valve spool in one of six available positions. In each of these positions identical orifices of the first and second circumferential rows of six orifices are each in alignment with pump ports leading to respective sides of the gear pump. As before, the valve spool is drivingly engaged with an electronic rotary switch having six contacts and corresponding detent positions also located at 60 degree intervals. The switch detent controls stopping locations for the rotary switch's electrical contacts and the valve spool as well. The electrical contacts are utilized to convey orifice selection information to the controller. Concomitantly, a pressure transducer is utilized to convey a signal representative of instant pressure values across the return orifice to the controller. Then the controller is able to determine the applied power and energy values according to equation (2) via the power and energy computation methods presented above.

As is also mentioned above, the relatively severe oxygen debt engendered by a stress test is similar to that commonly resulting from normally discouraged activities such as shoveling snow. Overcoming the resulting effects can require a significant recovery period and set back even an experienced participant's conditioning program significantly. This is largely due to the vastly improved performance levels of which the experienced participant is capable. In the example cited above, the inventor delivered additional power to the treadmill in the amount of 0.449 [horsepower] for 3 minutes in comparison with his prior stress test performance. This amounted to an extra 44,450 [ft. lbs.] or about 14.4 [Calories] of energy delivered to the treadmill. The problem with this is that the body is quite inefficient under the required conditions of rapid leg movement up a steep incline. Further, this extra energy was required under anaerobic conditions wherein the chemical energy source therefor was inefficient utilization of decomposing muscle tissue. Assuming a drastically reduced energy conversion efficiency of 5%, the inventor's body was required to provide additional anaerobic energy in the order of 290 [Calories] during a time period of only 3 minutes. Now, in spite of his improved condition (and stress test performance), he was still a 66 year old heart patient whereby such an abrupt anaerobic energy expenditure constituted quite a shock.

Because of the underlying risk factors evidenced by this example, apparatus and method for cardiovascular stress testing are provided according to a fourth alternate preferred embodiment of the present invention wherein RRE apparatus of the present invention is utilized in conjunction with corresponding method and apparatus for determining applied power and energy during cardiovascular stress testing. This is possible because the RRE mode of operation characteristically allows high power input values at high repetition rates. The cardiovascular stress testing is conducted with the heart patient electrocardiographically connected as in present stress testing. In this case however, it is necessary to eliminate the gross motion of the arms. This is because resulting chest muscle activation would otherwise disturb the electrical signals required for collecting the electrocardiographic data. For this reason, the arm supporting rope lines are eliminated. They are replaced by a hand bar for the heart patient to hold on to and achieve stability as he or she exerts the required leg forces.

In the fourth alternate preferred embodiment, a coefficient of performance (hereinafter "COP") for applied power is utilized. As defined herein, a nominal COP value of 100% is based upon the assumed ability of an average healthy 150 pound human to continuously deliver an applied power value of 0.1 [horsepower] or 3300 [ft.lbs./min.]. In order to standardize results, COP values for any particular heart patient must reflect that heart patient's weight. In implementing COP values for a particular heart patient, actual applied power values delivered by that heart patient are multiplied by the product of 100 [%] and the ratio of 150 [lbs.]/3300 [ft.lbs./min.] and divided by his or her weight. Thus, the heart patient's actual COP is determined by the formula $$COP=4.545\ (Pwr/Wt) \tag{5}$$

where 4.545 is the numerical value of (100×150)/3300 (e.g., in [%min./ft.]), Pwr is again the applied power (e.g., in [ft.lbs./min.]) and Wt is the heart patient's weight (e.g., in [lbs.]). By inverse logic, the 175 pound inventor would have to deliver applied power at (100 175)/4.545=3,850 [ft.lbs./min.]=87 [watts]=0.117 [horsepower]=532 [Kilogram-Meters/min.], or alternately, at a rate of 75 Cal./Hour in order to achieve a COP of 100%. Using his above derived actual applied average power of 8,475 [ft.lbs./min.] in the above formula results in a COP of 220%. Remembering that this applied average power value is maintained for 30 minutes, it seems reasonable that he could indeed be expected to achieve a COP of 100% continuously.

In implementing the improved method for cardiovascular stress testing, a heart patient observes target and actual COP read outs while he or she performs RRE. After the heart patient's weight is programmed in the controller, the target COP read out increases linearly in value as a function of time with a maximum COP value being perhaps 400% (e.g., a value close to that attained during stage 6 of present treadmill stress tests) reached at a maximum elapsed time of perhaps 20 minutes. The actual COP read out changes in response to the heart patient's actual COP values as the test progresses. An appropriate orifice (or field strength in the case of the RRE apparatus of the second alternate preferred embodiment) is selected and the heart patient is instructed to progressively increase exercise intensity (i.e., through higher repetition rates and/or longer stroke length) in order to keep the actual COP value ahead of the relentlessly increasing target COP value. The patient's ultimate test performance is determined by the final target COP value whereat he or she is no longer able to keep the actual COP value ahead of the target COP value. This should cause any ischemic problems to show up on the electrocardiographic data. The testing is terminated either when the heart patient is unable to keep up, or upon encountering ischemia or any other irregularity.

During the above testing it is quite possible that a heart patient might exceed his or her aerobic RRE limit and enter anaerobic exercise. As a matter of fact, in the case of a truly compromised heart patient being evaluated for heart transplant, anaerobic exercise would normally be encountered at very low COP values. In this case, it is desirable to utilize exhaled breath analysis for detecting such a transition to anaerobic exercise precisely. Thus, in some cases respiration analysis equipment would be utilized in conjunction with the RRE apparatus in addition to the standard electrocardiographic equipment.

The above described method of cardiovascular stress testing is better balanced with respect to a particular heart patient's anatomical differences. Although a taller heart patient will probably have a longer stroke length, a shorter heart patient of the same weight will presumably have more leverage and thus be able to generate higher leg forces. These factors serve to balance one another with the result that heart patients' output power levels are more directly comparable.

In a seventh aspect then, the present invention is directed to a method for determining instant values of power applied to RRE apparatus configured in compliance with the second aspect of the present invention wherein the method comprises the steps of: conveying a first signal representative of the area of the selected orifice to the controller; actuating the RRE apparatus such that there is a flow of fluid through the selected orifice; measuring fluid pressure present in the fluid delivered to the selected orifice; conveying a second signal representative of fluid pressure present in the fluid delivered to the selected orifice to the controller; and determining instant values of power applied to the RRE apparatus (10) according to the formula $$Pwr=C_dA(2/\rho)^{0.5}(P)^{1.5} \tag{1}$$

where Pwr is a signal representative of an instant value of applied power, $C_d$ is a signal representing the operative flow coefficient, A is the first signal, ρ is a signal representing fluid density, and P is the second signal.

In an eighth aspect, the present invention is directed to a method for determining instant values of power applied to RRE apparatus configured in compliance with the third aspect of the present invention wherein the method comprises the steps of: conveying a first signal representative of the areas of the substantially identical first and second selected orifices to the controller; actuating the RRE apparatus such that there is a flow of fluid through the first and second selected orifices and the return orifice; measuring pressure present in the partially spent fluid delivered to the return orifice; conveying a second signal representative of pressure present in the partially spent fluid delivered to the return orifice to the controller; and determining instant values of power applied to the RRE apparatus according to the formula $$Pwr=C_d((2A_o^3+2A_o^2A_r+A_oA_r^2+A_r^3)/A_o^2)(2/\rho)^{1/2}(P_t)^{3/2} \quad (2)$$

where Pwr is a signal representative of an instant value of applied power, $C_d$ is a signal representing the operative flow coefficient, $A_o$ is the first signal, $A_r$ is a signal representing the area of the return orifice, ρ is a signal representing fluid density, and $P_t$ is the second signal.

In a ninth aspect, the present invention is directed to a method for determining running values of power applied to RRE apparatus configured in compliance with either of the second or third aspects of the present invention wherefor first and second temperature transducers for respectively measuring energy dissipative hydraulic assembly and ambient temperatures are provided, and wherein the method comprises the steps of: actuating the RRE apparatus such that power is dissipated in the energy dissipative hydraulic assembly; measuring the temperature of the energy dissipative hydraulic assembly; conveying a first signal indicative of the temperature of the energy dissipative hydraulic assembly to the controller; measuring the ambient temperature; conveying a second signal indicative of the ambient temperature to the controller; sampling the first signal at sequential equal increments of time; subtracting the immediately previous first signal value from the instant first signal value to obtain a differential first signal value; determining the rate of change of the first signal by dividing the differential first signal value by the increment of time; determining values of power applied to the RRE apparatus according to the formula $$Pwr=K_1dT_o/dt+K_2(T_o-T_a)+K_3(T_o^4-T_a^4) \quad (3)$$

where Pwr is a signal representative of an instant value of applied power, $K_1$ is a first constant relating to transient heating determined by calibration procedures, $dT_o/dt$ is the rate of change of the first signal, $K_2$ is a second constant relating to heat transfer via conduction and convection determined by calibration procedures, $(T_o-T_a)$ is the difference between the first and second signals, $K_3$ is a third constant relating to heat transfer via radiation also determined by calibration procedures, and $(T_o^4-T_a^4)$ is the difference in the first and second signals each raised to the fourth power; and multiplying the running value of applied power by a constant suitable for its conversion into any desirable units such as Kilogram-Meters/minute.

In a tenth aspect, the present invention is directed to a method for determining instant values of power applied to RRE apparatus configured in compliance with the fourth aspect of the present invention wherein the method comprises the steps of: actuating the RRE apparatus such that there is a flow of electrical current delivered to the resistor bank; measuring voltage associated with the flow of electrical current to the resistor bank; conveying a signal indicative of the voltage associated with the flow of electrical current to the resistor bank to the controller; and determining instant values of power applied to the RRE apparatus according to the formula $$Pwr=V^2/R \quad (4)$$

where Pwr is a signal representative of an instant value of applied power, V is the signal indicative of the voltage associated with the flow of electrical current to the resistor bank, and R is a signal representing the resistance value for the resistor bank.

In an eleventh aspect, the present invention is directed to a method for generating running values of power applied to an RRE apparatus in conjunction with any of the methods for determining instant values of power applied to RRE apparatus, wherein the method comprises the steps of: sampling instant values of applied power once during each unit of time where a time unit is a selected fraction of average RRE apparatus cycle time; summing the first N samples of instant applied power values over N time units where N time units are at least equal to a maximum RRE apparatus cycle time; dividing by the number N to obtain a first average value of applied power; concomitantly eliminating the oldest sample of instant applied power values and adding the most recent sample thereof; dividing by the number N to obtain the running value of applied power; and multiplying the running value of applied power by a constant suitable for its conversion into any desirable units such as Kilogram-Meters/minute.

In a twelfth aspect, the present invention is directed to a method for generating a running applied energy value for energy applied to an RRE apparatus in conjunction with either of the methods for determining running values of power applied to an RRE apparatus, wherein the method comprises the steps of: partitioning time into time increments each defined by a sequential passage of N time units; multiplying the running value of applied power attained at the end of each time increment by a value of time equal to the N time units to determine a value of applied energy for that particular time increment; generating a running sum of the applied energy values to determine the running value of energy applied to the RRE apparatus; and multiplying the running value of applied energy by a constant suitable for its conversion into any desirable units such as Calories.

Actually of course, the pressure, temperature or voltage measurements can be made on any of the RRE apparatus with running values of applied power leading to COP being determined according to equation (5) above and running energy values determined according to the steps depicted in the twelfth aspect. These values can then be presented to any participant in conjunction with any of the RRE apparatus—at least as an available option. Although not depicted in the various figures pertaining thereto; a controller comprising a read out display is indeed offered as an option for any of the RRE apparatus.

In a thirteenth aspect then, the present invention is directed to a method for determining a COP for a horizontally disposed participant utilizing RRE apparatus configured in compliance with the first aspect of the present invention and additionally comprising a controller and means for providing the controller with a suitable signal or signals for determining running values of power applied to the RRE apparatus based upon the signal or signals, where a COP value of 100% is referenced to the assumed ability of an average healthy 150 pound human to continuously deliver applied power at a 0.1 [horsepower] rate, and wherein the method comprises the steps of: programming the participant's weight in the controller; positioning the participant under the RRE apparatus in a horizontally disposed manner; coupling the horizontally disposed participant's limb groups to the rope lines; supporting or balancing the weight of the limb groups one against the other via respectively coupling the rope lines to opposite sides of the drive assembly; coupling the drive assembly to the energy dissipative assembly; drivingly elevating and lowering the limb groups in an alternate manner against a resistive mechanical impedance load presented by the energy dissipative assemble thereby applying power thereto; dissipating the applied power as heat; determining running values of applied power; determining running values of the participant's COP according to the formula $$COP=K(Pwr/Wt) \quad (6)$$

where K is a dimensioned constant utilized to rectify units of measurement (e.g., 4.545 [%min./ft.] in the English units used above), Pwr is a signal representing the running applied power value and Wt is a signal representing the participant's weight; and presenting the participant's COP value to him or her.

In a fourteenth aspect, the present invention is directed to a particular combination of the elements identified above. More particularly, in this fourteenth aspect, the present invention is directed to RRE apparatus for use in cardiovascular stress testing of a horizontally disposed heart patient, comprising: pulley supported rope lines respectively coupled to the extremities of the legs of the horizontally disposed heart patient; a hand bar for the heart patient to hold on to and achieve stability as he or she implements RRE via drivingly elevating and lowering the legs; a drive assembly coupled to the rope lines; an energy dissipative assembly coupled to the drive assembly; a combining and supporting structure; a controller; means for providing the controller with a suitable signal or signals for determining running values of power applied to the RRE apparatus based upon the signal or signals; and electrocardiographic equipment for collecting electrocardiographic data as the heart patient implements RRE; the combination for nominally supporting or balancing the weight of the horizontally disposed heart patient's legs one against the other such that the heart patient is able to alternately apply lifting force to the left leg while pulling down on the right and then lifting force to the right leg while pulling down on the left, for dissipating power applied by the heart patient while he or she periodically elevates and lowers the legs in an alternate rhythmic manner, and for enabling the generation of a coefficient of performance produced by the heart patient concomitantly with the gathering of electrocardiographic data in order to test his or her cardiovascular capacity as he or she implements RRE.

In a fifteenth and final aspect, the present invention is directed to a method for testing cardiovascular capacity of a horizontally disposed heart patient utilizing RRE apparatus configured according to the fourteenth aspect of the present invention via generating running COP values, wherein the method comprises the steps of: programming the heart patient's weight in the controller; hooking up the heart patient to the electrocardiographic equipment; positioning the heart patient under the RRE apparatus in a horizontally disposed manner; coupling the horizontally disposed heart patient's legs to the rope lines; supporting or balancing the weight of the legs one against the other via respectively coupling the rope lines to opposite sides of the drive assembly; coupling the drive assembly to the energy dissipative assembly; instructing the heart patient to elevate and lower his or her legs in an alternate manner against a resistive mechanical impedance load presented by the energy dissipative assembly thereby applying power thereto; dissipating the applied power as heat; determining running values of applied power; determining running values of the heart patient's COP according to the formula $$COP=K(Pwr/Wt) \quad (6)$$

where K is a dimensioned constant utilized to rectify units of measurement (e.g., 4.545 [%min./ft.] in the English units used above), Pwr is a signal representing the running applied power value and Wt is a signal representing the heart patient's weight; presenting a target COP value to the heart patient; presenting the heart patient's actual COP value to him or her; increasing the target COP value as a function of time; instructing the heart patient to observe his or her actual COP value and keep it ahead of the increasing target COP value by exercising in a progressively more vigorous manner via higher repetition rates and/or longer stroke length; terminating testing either when the heart patient is no longer able to exceed the increasing target COP value, or alternately, upon the patient encountering ischemia or any other irregularity; and evaluating resulting electrocardiographic data with reference to synchronously obtained COP values.

BRIEF DESCRIPTION OF THE DRAWING

A better understanding of the present invention will now be had with reference to the accompanying drawing, wherein like reference characters refer to like parts throughout the several views herein, and in which:

FIGS. 2A and 2B are perspective views depicting leg and arm supporting straps utilized in conjunction with the preferred embodiment of the present invention;

FIG. 3 is a perspective view of modified footwear utilized in conjunction with the preferred embodiment of the present invention;

FIGS. 4A and 4B are partially schematic sectional views of an energy dissipative hydraulic assembly utilized in conjunction with the preferred embodiment of the present invention;

FIG. 16 is a view of a read out display utilized in conjunction with implementation of the measurement of applied power to apparatus of the present invention.

DETAILED DESCRIPTION OF THE PREFERRED EMBODIMENT

Figure 1:
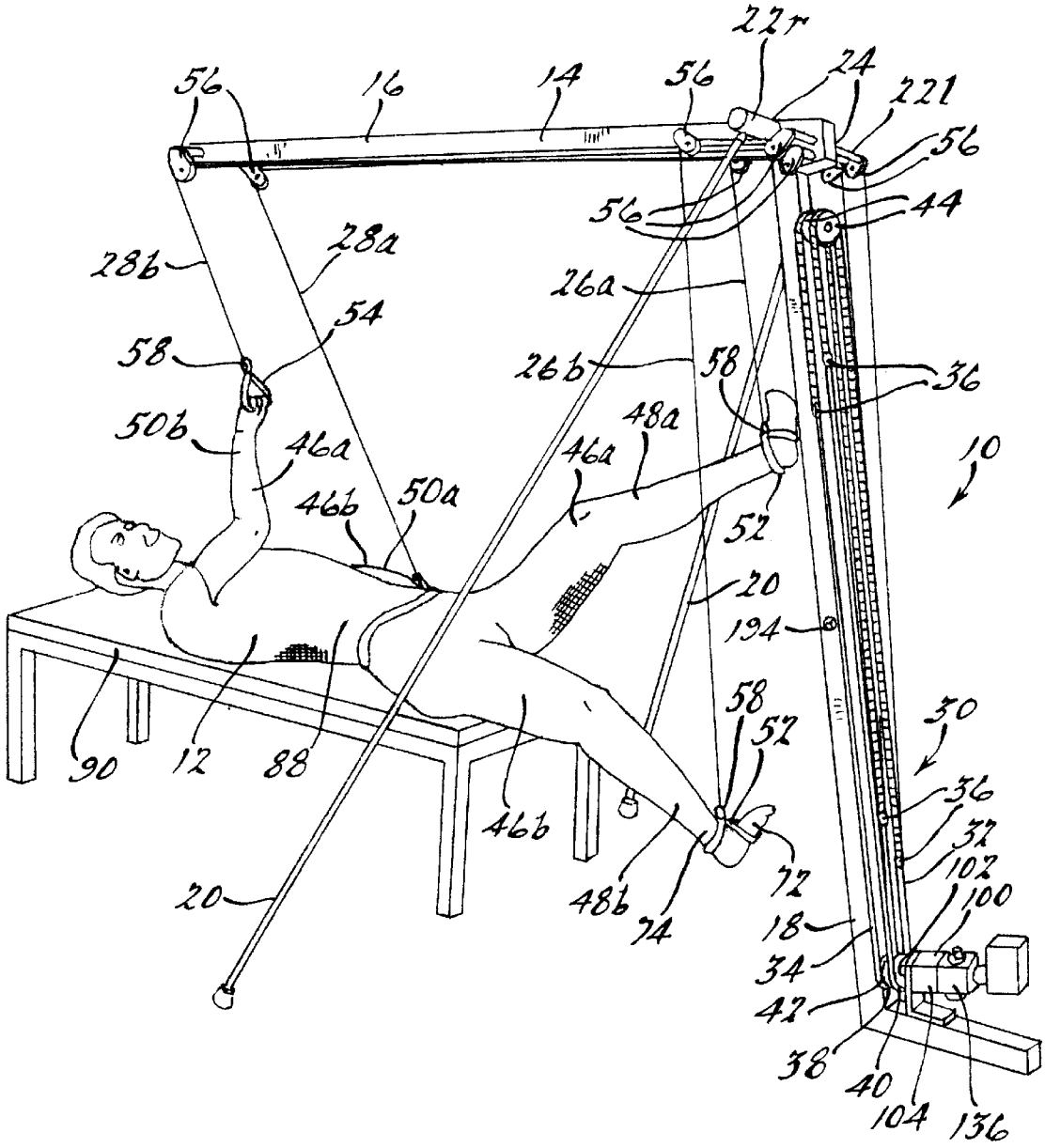
FIG. 1 is a perspective view of RRE apparatus according to a preferred embodiment of the present invention wherein a participant is depicted in a striding position.

With reference first to FIG. 1, RRE apparatus 10 utilized for enabling RRE according to a preferred embodiment of the present invention is thereshown in a perspective view depicting a participant 12 in a striding position as achieved during RRE. As depicted in FIG. 1, the RRE apparatus 10 utilizes a tripod structure 14 for general support. The tripod structure 14 comprises an overhead supporting member 16, a central leg 18, and two removable legs 20. The removable legs 20 are inserted into left and right receiver tubes 22*l* and 22*r* formed as part of a cross member 24.

Left leg and right arm supporting rope lines 26*a* and 28*b*, respectively, and right leg and left arm supporting rope lines 26*b* and 28*a*, respectively, are respectively coupled to either side of a drive belt assembly 30 comprising leg and arm drive belts 32 and 34, respectively, via coupling links 36. The leg and arm drive belts 32 and 34 are coupled, in turn, to a compound drive sprocket assembly 38 comprising leg drive sprocket 40 and arm drive sprocket 42. The leg and arm drive belts 32 and 34 are additionally routed over idler sprockets 44 for return to compound drive sprocket assembly 38. Coupling opposite legs and arms to opposing sides of the same compound drive sprocket assembly 38 results in each of first and second limb groups 46*a* and 46*b* comprising opposite legs and arms 48*a* and 50*b*, and 48*b* and 50*a*, respectively, moving alternately during RRE. And, utilizing respective leg and arm drive sprockets 40 and 42 of differing sizes results in leg and arm stroke lengths being related by the ratio of the number of teeth on either sprocket (e.g., 28 teeth on leg drive sprocket 40 and 22 teeth on arm drive sprocket 42 resulting in their respective stroke lengths being related by a factor of 1.27).

The rope lines 26*a*, 26*b*, 28*a* and 28*b* are utilized for conveying forces between the participant's legs 48 and arms 50 and the leg and arm drive belts 32 and 34 via leg and arm supporting straps 52 and 54, respectively. Forces required for nominally supporting or balancing the weight of either limb group 46*a* or 46*b* against the other is provided via straps 52 and 54 supporting one limb group, a corresponding pair of rope lines 26*a* or 26*b* and 28*b* or 28*a*, the combination of drive belt and compound drive sprocket assemblies 30 and 38, the opposing pair of rope lines 26*b* or 26*a* and 28*a* or 28*b*, and the opposing straps 52 and 54. Of especial significance is the fact that rope lines 26*a*, 26*b*, 28*a* and 28*b* are utilized to convey forces applied by the participant 12 to RRE apparatus 10.

The rope lines 26*a*, 26*b*, 28*a* and 28*b* are routed over supporting pulleys 56 similar to the type commonly utilized for rigging rope lines in sail boats. The supporting pulleys 56 are configured similarly to "Small Boat Blocks" available from The Harken Company of Pewaukee, Wis. In this case however, an industrial ball bearing is substituted for their normally comprised double rows of all weather plastic ball bearings in order to withstand the continuous operation of RRE implementing apparatus of the present invention. Connection to the leg and arm supporting straps 52 and 54 is accomplished via spring hooks 58 such as those available from the Baron Manufacturing Co. of Addison, Ill.

The leg and arm supporting straps 52 and 54 are respectively depicted in greater detail in FIGS. 2A and 2B. As shown in FIG. 2A, the leg supporting straps 52 are formed primarily from two identical 3-inch wide by 12-inch long strips 60. The strips 60 comprise neoprene foam with stretchable nylon cloth bonded to each side, which material is available from the Rubatex Corporation of Roanoke, Va. The strips 60 are cut with juxtaposed mitered edges 62 such that a "D" ring 64 can be captured in a close-coupled manner by a combining strip 66 of webbing material. The combining strip 66 is formed generally in a "U" shape capturing the "D" ring 64 and the two strips 60 overlapped at an approximate 90 degree angle. In particular, the combining strip 66 is folded in the "U" shape thus capturing the overlapped strips 60 and the "D" ring 64 and is securely stitched. In particular, the "D" ring 64 is captured and the combining strip 66 and strips 60 secured by stitching as indicated generally by reference numerals 68. In addition, triangular side overlapped portions of the strips 60 are also stitched as indicated by reference numerals 70. The above described arrangement is typical on both ends of the strips 60. Thus, the leg supporting straps 52 each have two "D" rings 64 and support the foot 72 and ankle 74 of the participant 12 in a manner similar to a sling.

Figure 8:
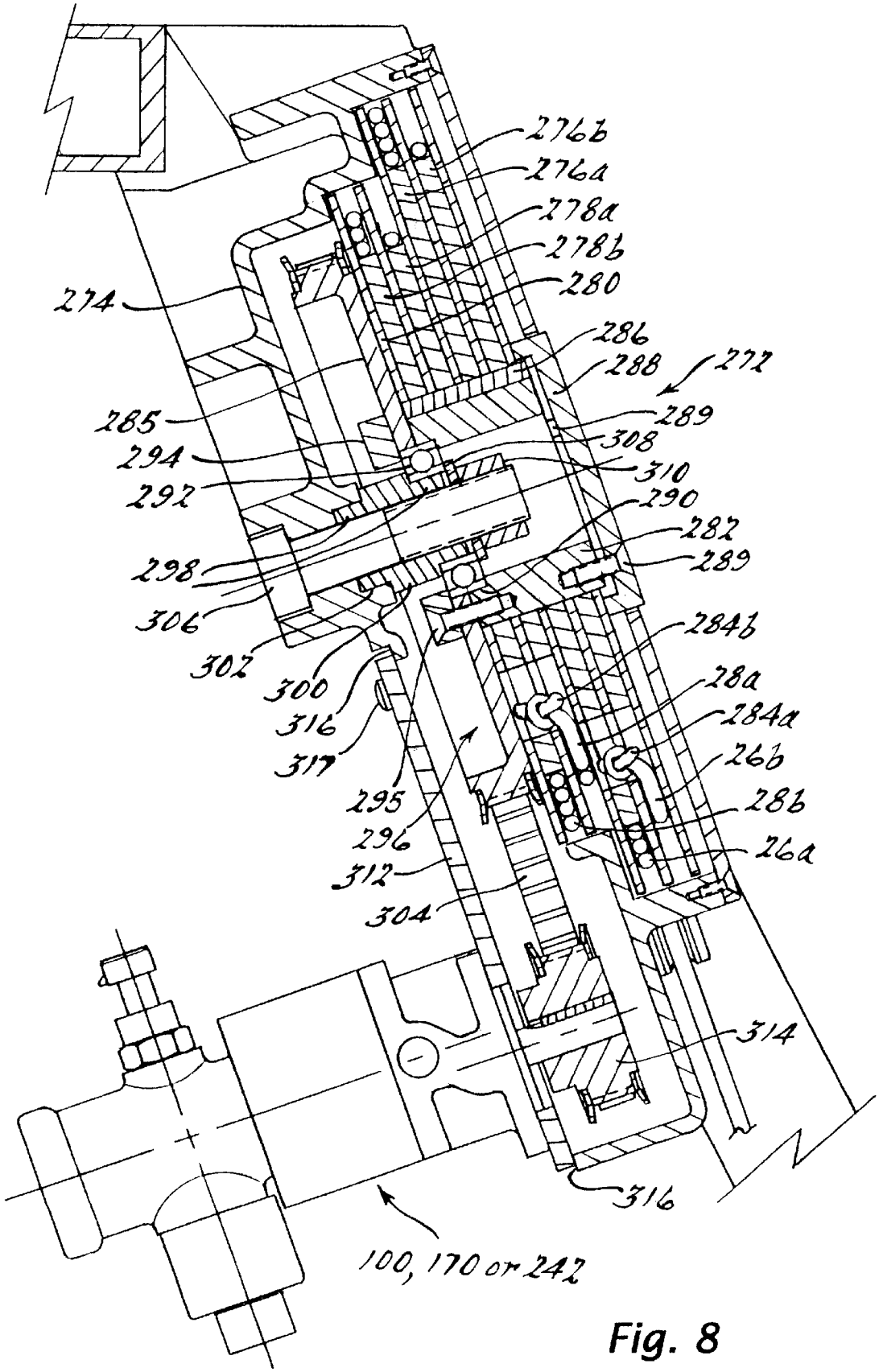
FIG. 8 is a sectional view of a drive assembly utilized in the RRE apparatus of the second alternate preferred embodiment of the present invention.

As depicted in FIG. 2B, the arm supporting straps 54 comprise a strip 76 of similar webbing material formed in a "figure 8" manner with a small loop 78 capturing another "D" ring 64 and a larger loop 80 enabling engagement by the fingers 82 of the participant 12. The strip 76 is formed in the "figure 8" manner and stitched as indicated generally by the reference numeral 84. In particular, the method used generally for capturing the "D" ring 64 is by stitching as indicated by the reference numeral 86.

Referring now to FIG. 3, thereshown is modified footwear 92 for use in extending the location of the applied leg forces during RRE such that the various leg muscles and tendons of the participant 12 are subject to increased loading during exercise in the RRE mode. In this case "D" rings 64 have been affixed to the modified footwear 92 at two positions 94 and 96 respectively shown above the "balls" of the feet and beyond the toes. It has been found that this especially improves development of the Achilles tendons, calves and hamstrings of the participant 12.

As shown in FIG. 1, the horizontally disposed torso 88 of a participant 12 is supported by a padded short and narrow table 90 (i.e., such as a weight lifting bench). When a participant 12 is exercising on RRE apparatus 10, the weight of each limb group 46*a* or 46*b* is nominally supported by the weight of the other limb group 46*b* or 46*a* via the rope lines 26*a*, 26*b*, 28*a* and 28*b*, drive belts 32 and 34, and compound drive sprocket assembly 38 as described above. In the RRE mode the limb groups 46*a* and 46*b* are alternately elevated and lowered as in a striding or running mode. Utilizing such a short and narrow table 90 to support only the torso 88 allows the participant 12 to work his or her legs 48 and arms 50 both above and below torso height. Because of generally balanced body dynamics associated with the RRE mode, it is possible to utilize relatively long stride lengths in conjunction with repetition rates as high as 120 strides per minute or even higher. The combination of high repetition rate and long strides allows a participant 12 to generate significant levels of applied power. The RRE mode depicted in FIG. 1 has particularly been shown to be optimum for exercising quad and hamstring muscles.

Referring now to FIGS. 4A and 4B, thereshown in sectional views is an energy dissipative hydraulic assembly 100 utilized for dissipating applied power delivered by a participant 12 to the RRE apparatus 10. As shown in FIG. 1, the compound drive sprocket assembly 38 is mounted on a drive shaft 102 of a reversible gear pump 104. Depending upon pump rotation direction, pressurized fluid flow generated by the reversible gear pump 104 passes through either of pump ports 106*a* or 106*b* toward a three-way check valve assembly 108 via respective passages 110*a* or 110*b* formed in a valve housing 136 and ports 112 formed in respective fittings 114*a* and 114*b*. The three-way check valve assembly 108 comprises first and second balls 116*a* and 116*b* and seats 118*a* and 118*b* respectively formed in the fittings 114*a* and 114*b*. In addition, cylindrical barrier 119 formed on the fitting 114*a* is used to contain the balls 116*a* and 116*b* as they respectively shuttle between the seats 118*a* and 118*b*. The pressurized fluid flow then passes through ports 120 and/or an annular gap 121 formed between cylindrical barrier 119 and the fitting 114*a*, and then through pressure port 122 on its way to, and through, a selected one of a set of orifices 124 formed in a rotary valve spool 126 to a bore 128 also formed in the rotary valve spool 126. The bore 128 is fluidly in communication with a reservoir 130 via passages 132 formed in the rotary valve spool 126 and a fluid return port 134 formed in the valve housing 136.

Fluidic power equal to the product of instant flow rate and pressure drop across the selected one of the set of orifices 124 is dissipated as heat. The orifices 124 are graduated in size and are radially located in the rotary valve spool 126 about the bore 128. The selected orifice 124 is chosen via rotative alignment of the rotary valve spool 126 in one of six available positions. As a result, one orifice 124 is in alignment with the output pressure port 122 and is thus fluidly coupled between the three-way check valve assembly 108 and the reservoir 130 in each of these positions.

Concomitantly, one of two-way check valve assemblies 138*b* or 138*a* respectively directs suction flow from the reservoir 130 via suction port 140*b* or 140*a* to the other or instant suction one of the pump ports 106*b* or 106*a* via respective passages 110*b* or 110*a*. Each of the two-way check valve assemblies 138*b* and 138*a* comprises a ball 142*b* or 142*a*, a seat 144*b* or 144*a*, and a retaining ring 146*b* or 146*a*, respectively. Suitable retaining rings are available for this purpose from Waldes Truarc of Millburn, N.J. and are known as Circular Push-On Internal Series 5005 retaining rings.

The particular flow pattern depicted in FIG. 4B, illustrates the case wherein the pump ports 106*a* and 106*b* are the respective instant pump output and suction ports. As illustrated, the flow pattern comprises pressurized fluid flow out of pump port 106*a* and through passage 110*a*, ports 112 formed in fitting 114*a*, the annular space between seat 118*a* and ball 116*a*, the ports 120 and/or annular gap 121, the output pressure port 122, the selected one of the orifices 124, the bore 128, passages 132 and finally through fluid return port 134 to the reservoir 130. As further illustrated, suction flow originates from the reservoir 130 and flows through suction port 140*b*, the annular space between seat 144*b* and ball 142*b*, ports 148 formed adjacent to seat 144*b* and finally through passage 110*b* to the instant pump suction port 106*b*.

As depicted in FIG. 4A, the pressurized fluid can also be conveyed to an optional pressure transducer 150 from the three-way check valve assembly 108 via the output pressure port 122 and a pressure transducer port 152. When utilized, the pressure transducer 150 provides a signal indicative of instant pressure values present in the output pressure port 122, and therefore present in the fluid delivered to the selected one of the orifices 124. The signal indicative of instant pressure values is then utilized for calculation of instant applied power values in a controller 154 according to an algorithm presented below in equation (1). The selected one of the orifices 124 is normally chosen such that the resulting striding repetition rate is similar to that of a comfortable walking pace. Thus, stronger participants 12 will tend to use smaller orifices 124. As a result, stronger participants 12 will tend to achieve higher pressure and thus higher applied power values.

The rotary valve spool 126 is mechanically coupled to an electronic wafer switch assembly 156 via an Oldham coupling 158. The wafer switch assembly 156 comprises six contacts 162 for conveying orifice selection information to the controller 154. The wafer switch assembly 156 also comprises a detent mechanism 164 that precisely determines each of the six stopping positions for it as well as for the rotary valve spool 126. A control shaft 166 is formed on the other end of the rotary valve spool 126 for rotary manipulation by a knob 168. In general, O-ring seals 160 are provided in order to maintain fluid tight integrity of the energy dissipative hydraulic assembly 10. And finally, a diaphragm bellows seal 161 is utilized for one wall of the reservoir 130. The compliant nature of the diaphragm bellows seal 161 results in the fluid within the reservoir 130 being substantially held at atmospheric pressure. This precludes the instant suction one of the pump ports 106*a* and 106*b* from experiencing cavitation and provides atmospheric pressure on the reservoir side of the selected orifice 124. Thus when utilized, the pressure transducer 150 substantially renders a signal representative of actual pressure drop across the selected orifice 124 as required for proper implementation of the algorithm presented below in equation (1).

Figure 5A:
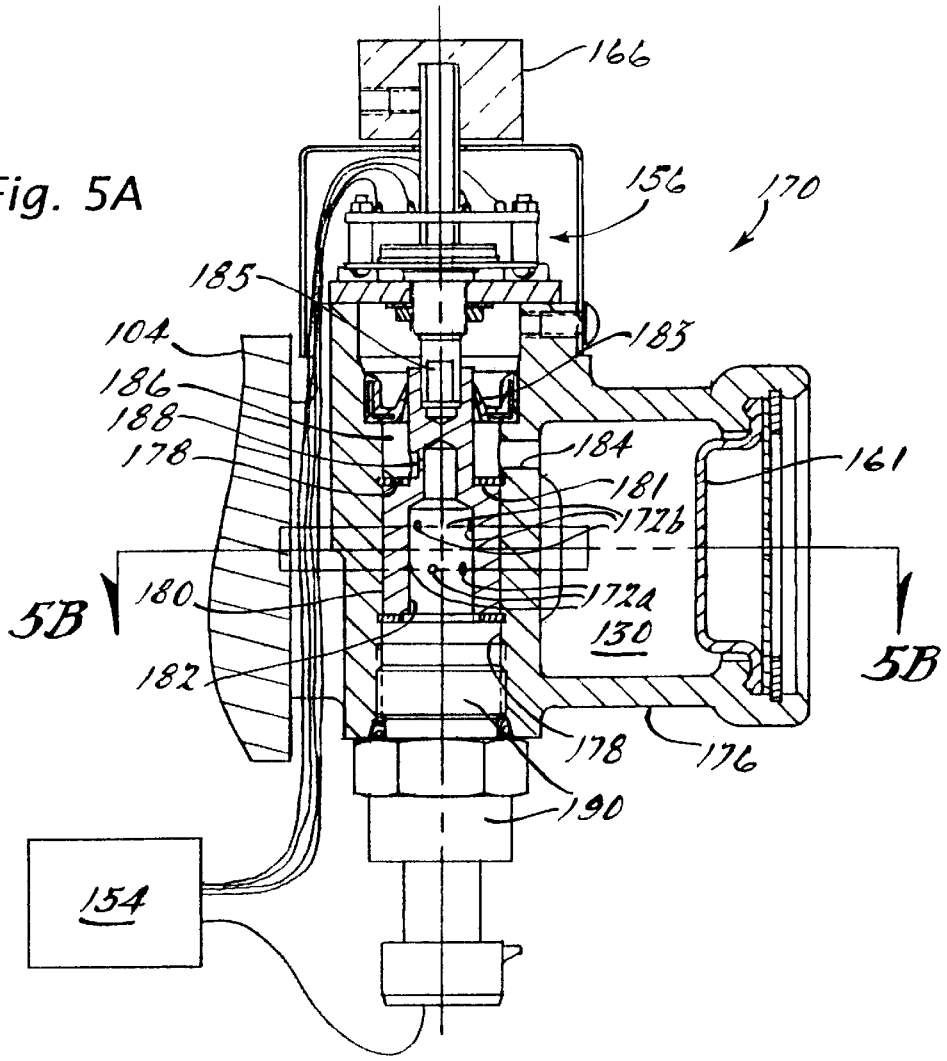
FIGS. 5A, 5B and 5C are partially schematic sectional views of an. alternate energy dissipative hydraulic assembly optionally utilized in conjunction with the preferred embodiment of the present invention.
Figure 5B:
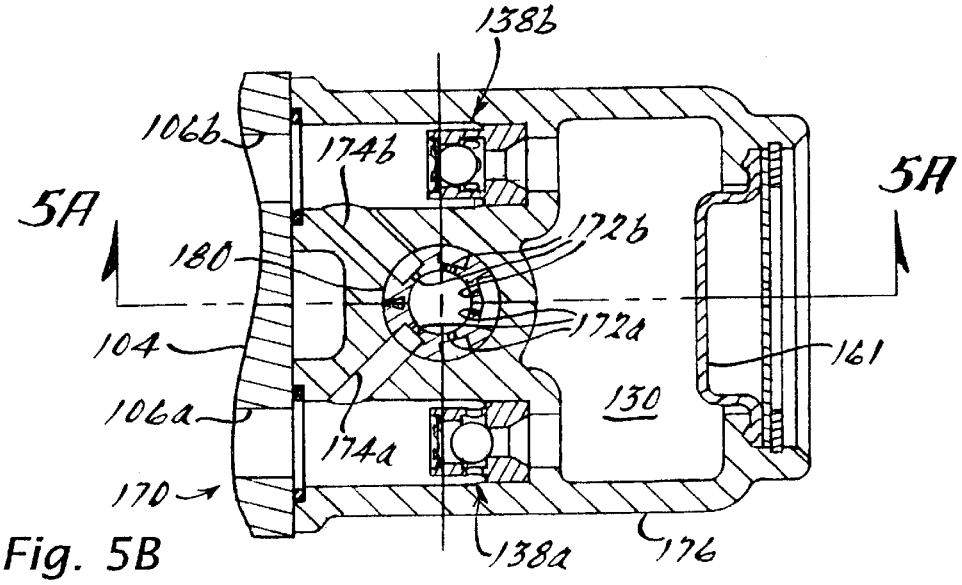

Referring now to FIGS. 5A and 5B, thereshown in sectional views is an energy dissipative hydraulic assembly 170 that may interchangeably be utilized in place of energy dissipative hydraulic assembly 100. An RRE apparatus utilizing the energy dissipative hydraulic assembly 170 (e.g., other than so equipped versions of RRE apparatus 200 and 270 described elsewhere herein) will be referred to herein as RRE apparatus 11 in order to differentiate it from RRE apparatus 10 utilizing energy dissipative hydraulic assembly 100. In any case, pressurized fluid flow generated by the reversible gear pump 104 in energy dissipative hydraulic assembly 170 passes through either of pump ports 106*a* or 106*b* toward respective identical selected ones of first or second sets of orifices 172*a* or 172*b* via respective passages 174*a* or 174*b* formed obliquely in a valve housing 176. A rotary valve spool 180 comprising the first and second sets of orifices 172*a* and 172*b* is received in bore 178 and positioned axially therein by internal retaining rings 181.

The orifices 172*a* and 172*b* are graduated in size and are radially located in the rotary valve spool 180 about an internal bore 182 thereof. In addition, the orifices 172*a* and 172*b* are axially and rotationally located on the rotary valve spool 180 such that identically sized ones thereof are juxtaposed to the respective passages 174*a* and 174*b* at each stopping position of the rotary valve spool 180. Orifices 172*a* and 172*b* are chosen via rotative alignment of the rotary valve spool 180 in one of six available positions. As before, these available positions are determined by a wafer switch assembly 156 this time positioned directly between a knob 168 and rotary valve spool 180 and coupled to the rotary valve spool 180 via double "D" flats 185 engaging a similarly contoured bore in rotary valve spool 180. As a result, identically sized ones of orifices 172*a* and 172*b* are in alignment with the respective passages 174*a* and 174*b* in each of these positions.

The pressurized fluid flow then passes from the passage 174*a* or 174*b* delivering pressurized fluid through the respective selected one of orifices 172*a* or 172*b* to the internal bore 182 giving up most of its pressure and thus becoming partially spent fluid as it does so. The partially spent fluid then divides with the smaller portion passing through the other selected one of orifices 172*b* or 172*a* to the other passage 174*b* or 174*a* where it joins suction fluid from the respective one of two way check valve assemblies 138*b* or 138*a* on its way to the other pump port 106*b* or 106*a*. The larger portion of the partially spent fluid passes through an optional return orifice 188 and an annular cavity 186 formed in and partially by the rotary valve spool 180 to and through a port 184 to the reservoir 130. The partially spent fluid is retained within the annular cavity 186 by shaft seal 183.

As is explained elsewhere herein, the return orifice 188 is required only when instant values of applied power are to be measured via utilization of a pressure transducer 190 and is not necessary in the basic power dissipation functioning of the energy dissipative hydraulic assembly 170. However, if the optional return orifice 188 is used, it is formed with a larger bore than the largest ones of the orifices 172*a* and 172*b*. Thus in either case, the majority of pressure drop occurs as the pressurized fluid passes through one of the selected orifices 172*a* and 172*b*. And of course, the flow rate of returning fluid passing into the reservoir 130 is identical to the flow rate of suction fluid passing through the opposite one of two-way check valve assemblies 138*b* and 138*a*.

The pressure transducer 190 is sealingly mounted in the open end of bore 178 and thus in fluid communication with the internal bore 182. It is used to provide a signal indicative of instant pressure values present in the internal bore 182 and thus delivered to the return orifice 188 to the controller 154. As in the energy dissipative hydraulic assembly 100, diaphragm bellows seal 161 guarantees that the pressure value measured by the pressure transducer 190 is substantially representative of the pressure value impressed across the return orifice 188. The resulting signal is utilized by the controller 154 to calculate instant applied power values in according to an algorithm presented below in equation (2). Other features of the alternate energy dissipative hydraulic assembly 170 are substantially identical to those of energy dissipative hydraulic assembly 100 and thus will not be further described herein.

Figure 5C:
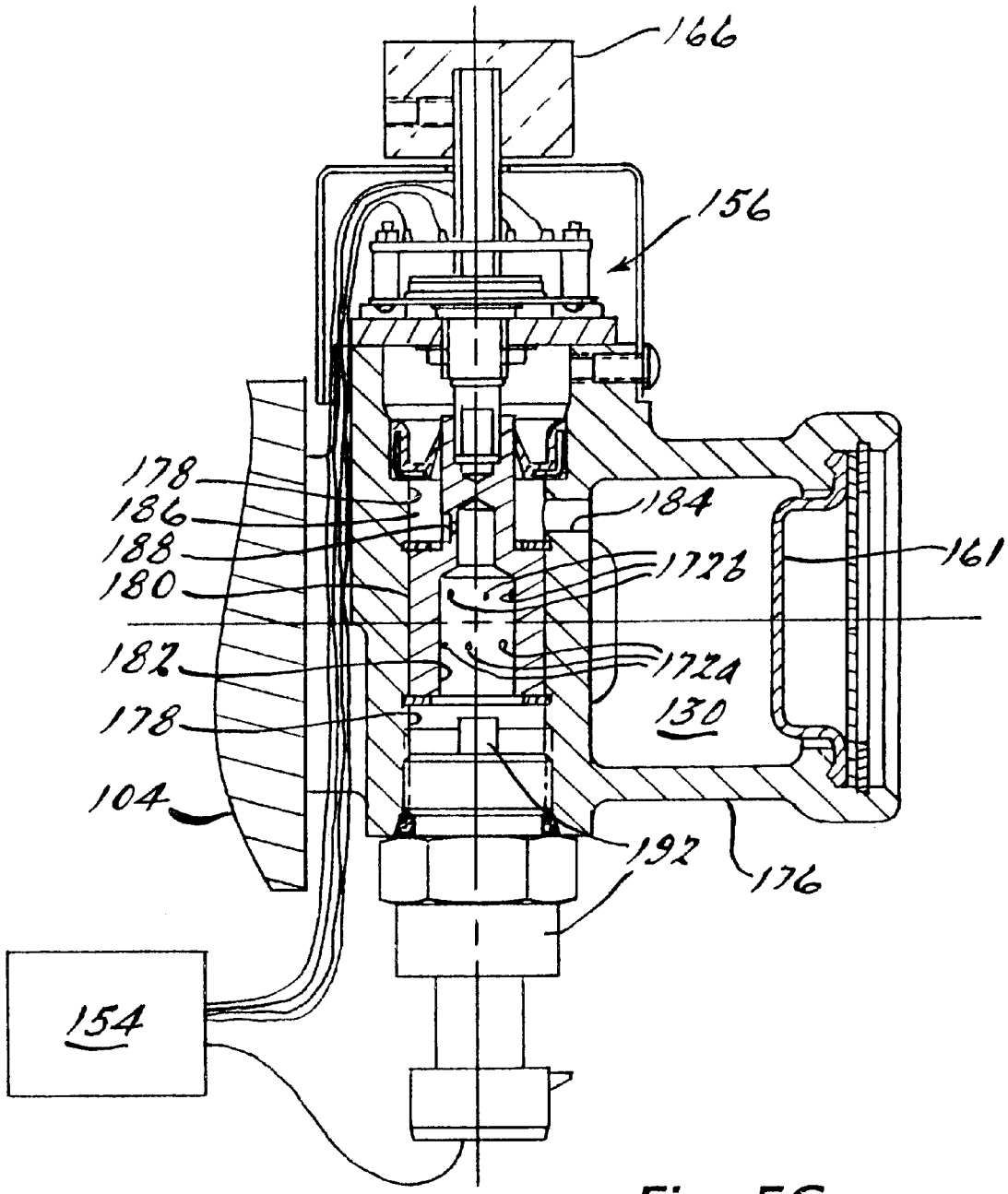

In FIG. 5C, a temperature transducer 192 utilized for generating a first signal indicative of energy dissipative hydraulic assembly temperature and alternately used for implementing applied power measurement is there shown. Although depicted in FIG. 5C as replacing pressure transducer 190 in the valve housing 176 of energy dissipative hydraulic assembly 170, the temperature transducer 192 can also be mounted in place of the pressure transducer 150 in valve housing 136 of energy dissipative hydraulic assembly 100. In either case, a temperature transducer 194 utilized for generating a second signal indicative of ambient temperature can conveniently be mounted on the central leg 18 as shown in FIG. 1 (or alternately on housing 274 or horizontal member 318 of an RRE apparatus 270 described below in conjunction with FIG. 7). The first and second signals are then used to calculate applied power values in the controller 154 according to an algorithm presented below in equation (3).

During normal upright running, the hamstring muscles are forced to work under both contraction and retardation modes. Of the two modes, the hamstring muscles are under greatest strain when stopping forward motion of the lower leg (i.e., just prior to the planting of the foot during running). One of the goals in training on the RRE apparatus 10 or 11 is to strengthen the hamstrings and fortify them against injury, especially during sprinting. Along with utilization of the modified footwear 92 described above, this is best accomplished by exercising at a relatively slow repetition rate (e.g., at the comfortable walking pace repetition rate mentioned above), but with significant applied force. In other words it is important to at least nominally match the resistive mechanical impedance load presented to the participant by either of the RRE apparatus 10 or 11 to the participant's own physical capability. This serves to keep the intensity of RRE down to an aerobic level whereat the blood pressure is maintained at substantially non-elevated values. It is believed herein that this results in maximum benefit because of the fact that lower blood pressure implies a greater number of dilated precapillary sphincter muscles in the working muscles of the body. As described above, this further implies more working capillary area and averagely shorter permeation distance for the exchange of oxygen and nutrients for carbon dioxide and waste byproducts in those working muscles. Thus, it is normally recommended that the one of the orifices 124, or the ones of the orifices 172*a* and 172*b*, resulting in about 80 strides per minute be selected via appropriate positioning of the knob 168.

Figure 6:
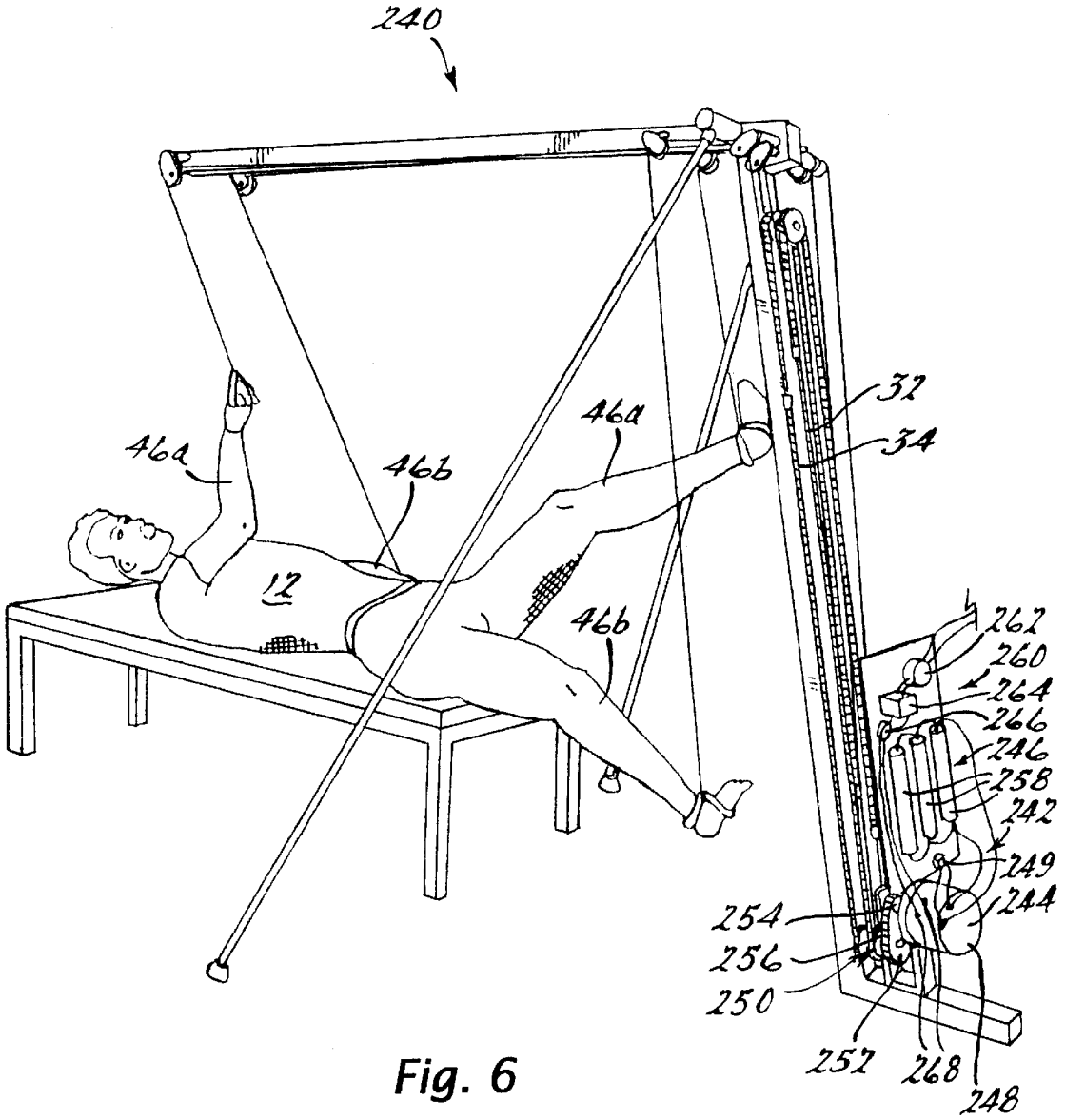
FIG. 6 is a perspective view of RRE apparatus according to a first alternate preferred embodiment of the present invention wherein a participant is depicted in a striding position.

With reference now to FIG. 6, RRE apparatus 240 utilized for enabling RRE according to a first alternate preferred embodiment of the present invention is thereshown in a perspective view depicting a participant 12 in a striding position as achieved during RRE. The RRE apparatus 240 is substantially identical in form and function to RRE apparatus 10 or 11 except that either of the interchangeable energy dissipative hydraulic assemblies 100 or 170 utilized in RRE apparatus 10 or 11 has been replaced by an energy dissipative electrical assembly 242. The energy dissipative electrical assembly 242 comprises electrical generating apparatus 244 and resistor bank 246. In general, any type of electrical generator could be used for electrical generating apparatus 244 (i.e., even including linear generator apparatus such as a linear motor directly coupled to either of the leg or arm drive belts 32 or 34). However, since the impetus for utilizing energy dissipative electrical assembly 242 is its hoped for lower cost, an automotive alternator 248 is perhaps the most obvious choice for electrical generating apparatus 244.

It should be noted in passing however, that any type of energy dissipative electrical assembly 242 is disadvantaged with reference to either of the energy dissipative hydraulic assemblies 100 or 170 because of its inherently higher reflected inertia as presented to an RRE participant 12. In the case of an automotive alternator 248, this is exacerbated by the necessity for utilization of a speed increasing mechanism 250 in order to enable the automotive alternator 248 to support expected loading values. In this case the speed increasing mechanism 250 comprises a large drive sprocket 252 driving a smaller drive sprocket 254 via an alternator drive belt 256.

However, one advantage of the energy dissipative electrical assembly 242 is the ease with which applied power can be measured. In this case a signal representing voltage applied to the resistor bank 246 is provided by a simple voltage transducer 249 generally comprising nothing more than a voltage divider. That signal can then be squared and divided by the resistance value of the resistor bank 246 in order to obtain instant values of applied power.

In general, high applied power levels possible with the RRE apparatus 240 dictate that the resistor bank 246 comprise multiple power resistors 258. While three such power resistors 258 could individually be directly coupled to each of the three phase windings of the automotive alternator 248 in order to eliminate its internally provided diode bridge circuit, the volume production of such alternators renders it less expensive to use such an automotive alternator as normally produced (e.g., with a dc output). In this case, the power resistors 258 are of course connected in parallel.

Actual power generated by the automotive alternator 248 at any particular rotational speed thereof is of course a function of instant field strength. Thus, variable control of the resistive mechanical impedance load presented to the RRE participant 12 is most simply obtained via varying the voltage applied to the internal slip rings of the automotive alternator 248. This can be accomplished in a variety of ways. One straight forward way is depicted in field drive circuit 260. In field drive circuit 260 normal two-phase power provided by the electrical utility is applied to a small variable transformer 262. The variable transformer 262 then provides a variably controlled intermediate ac voltage signal to a step-down transformer 264. The intermediate ac voltage signal is stepped down in value via the step-down transformer 264 and applied to an encapsulated diode bridge circuit 266. A controlled dc voltage is thus provided and is applied to field terminals 268 of the automotive alternator 248. Suitable automotive alternators, variable transformers and encapsulated diode bridge circuits useful for implementation of the energy dissipative electrical assembly 242 are respectively available from Prestolite Motor and Ignition of Toledo, Ohio, Superior Electric Co. of Bristol, CT and International Rectifier of El Segundo, Calif.

Figure 7:
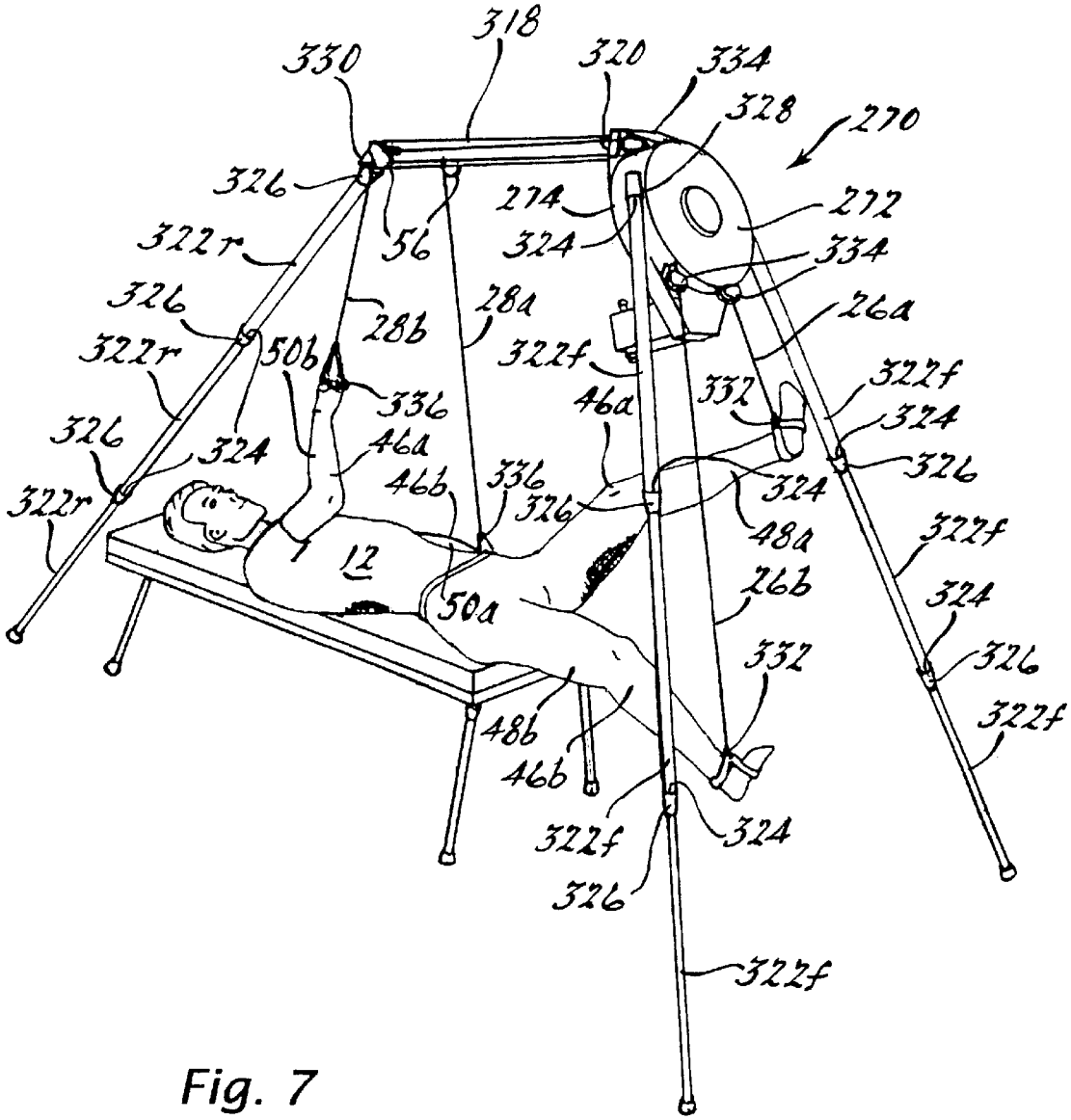
FIG. 7 is a perspective view of RRE apparatus according to a second alternate preferred embodiment of the present invention wherein a participant is depicted in a striding position.

With reference now to FIG. 7, RRE apparatus 270 utilized for enabling RRE according to a second alternate preferred embodiment of the present invention is thereshown in a perspective view depicting a participant 12 in a striding position as achieved during RRE. The RRE apparatus 270 is functionally identical to any of RRE apparatus 10, 11 or 240 except that the RRE apparatus 270 is configured in semi-portable fashion via locating all of its functional components in a single elevated assembly positioned above the horizontally disposed practitioner 12.

As shown in considerable detail in FIG. 8, drive assembly 272 is located in elevated housing 274 and comprises leg and arm supporting reels 276*a*, 276*b*, 278*a* and 278*b* each separated by barrier plates 280 and all commonly mounted upon a hub 282 along with a large timing belt sprocket 285. During assembly of the reels 276*a*, 276*b*, 278*a* and 278*b* and plates 280, rope lines 26*a*, 26*b*, 28*a* and 28*b* are respectively coiled in multi-turn fashion on reels 276*a*, 276*b*, 278*a* and 278*b*. The various reels and plates have slots and/or cavities as required for securing each of the rope lines with simple knots as shown for instance at numerical indicators 284*a* and 284*b*. The leg supporting reels 276*a* and 276*b* and the arm supporting reels 278*a* and 278*b* are of differing size in order to accommodate the differing leg and arm stroke lengths. The reels 276*a*, 276*b*, 278*a* and 278*b* and plates 280 are secured for rotation with the hub 282 by a key 286 and a retaining disc 288 secured by screws 289. Similarly, a bore 290 of the hub 282 and the large timing belt sprocket 285 are assembled upon the outer race of a ball bearing 292 and held thereon by a bearing retainer 294 secured by screws 295 thus forming a completed rotating group 296.

Next, one of two identical bosses 298 formed on either end of a bearing mount 300 is inserted in a bore 302 of the housing 274 and a timing belt 304 is inserted into the housing 274. Then the rotating group 296 is mounted upon the other of the bosses 298 (e.g., via the inner race of the ball bearing 292) and the timing belt 304 is pulled into engagement with the large timing belt sprocket 285. Then the rotating group 296 is secured for rotation within the housing 274 via the inner race of the ball bearing 292 and bearing mount 300 being held in place by a large bolt 306, washer 308 and nut 310.

Next, one of optional energy dissipative hydraulic or electric assemblies 100, 170 or 242 is mounted upon a plate 312. A small timing belt sprocket 314 is then secured on the input shaft of the chosen energy dissipative assembly 100, 170 or 242 in a standard manner. As the plate 310 is slidingly positioned onto machined surface 316 of the housing 274, care is taken to engage the downward extending timing belt 304 with the small timing belt sprocket 312. Finally, the plate 312 is slidingly positioned such that the timing belt 304 has sufficient tension and the plate 312 is secured to the housing 274 by bolts 317.

Referring again to FIG. 7, a horizontal member 318 is affixed to the housing 274 by bolts 320 and supported above the horizontally disposed participant 12 via assembled front and rear tripod legs 322*f* and 322*r*. The joints between individual tubular sections of the tripod legs 322*f* and 322*r* are formed with conical male taper sections 324 inserted into matching conical female taper sections 326. The front tripod legs 322*f* comprise conical male taper sections 324 inserted into matching conical bores 328 formed in either side of the housing 274 while the rear tripod leg 322*r* comprises a female conical taper section 326 assembled onto a matching male taper section 330 formed as an integral portion of the horizontal member 318.

In operation the horizontally disposed participant 12 is located such that the leg supporting reels 276*a* and 276*b* are nominally within the plane of motion of the leg attachment points 332 and the leg supporting rope lines 26*a* and 26*b* are coupled to the legs 48*a* and 48*b* with minimal fixed pulley support provided by two of pulleys 334. Concomitantly, the arm supporting rope lines 28*a* and 28*b* are routed via two more pulleys 334 generally along the horizontal member 318 to two supporting pulleys 56 and then downward to a point above arm attachment points 336 for optimal coupling to the arms 50*a* and 50*b*.

The leg supporting rope lines 26*a* and 26*b* are directed downward from the leg supporting reels 276*a* and 276*b* while the arm supporting rope lines 28*a* and 28*b* are concomitantly directed upward from the arm supporting reels 278*a* and 278*b*. Thus, either limb group 46*a* and 46*b* naturally moves alternately and synchronously as required. This is because the leg supporting rope lines 26*a* and 26*b*, and the arm supporting rope lines 28*a* and 28*b*, each respectively emanate from opposite sides of the reels 276*a*, 276*b*, 278*a* and 278*b*; and further because the left side set rope lines 26*a* and 28*a*, and the right side set of rope lines 26*b* and 28*b*, respectively move in counter directions because of their opposing emanation directions. And of course, the weights of the participant's limb groups 46*a* and 46*b* are supported or balanced one against the other as in any of the RRE apparatus 10, 11 and 240 via the emanation of the leg supporting rope lines 26*a* and 26*b* from opposite sides of the reels 276*a* and 276*b*, and of the arm supporting rope lines 28*a* and 28*b* from opposite sides of the reels 278*a* and 278*b*.

Figure 9:
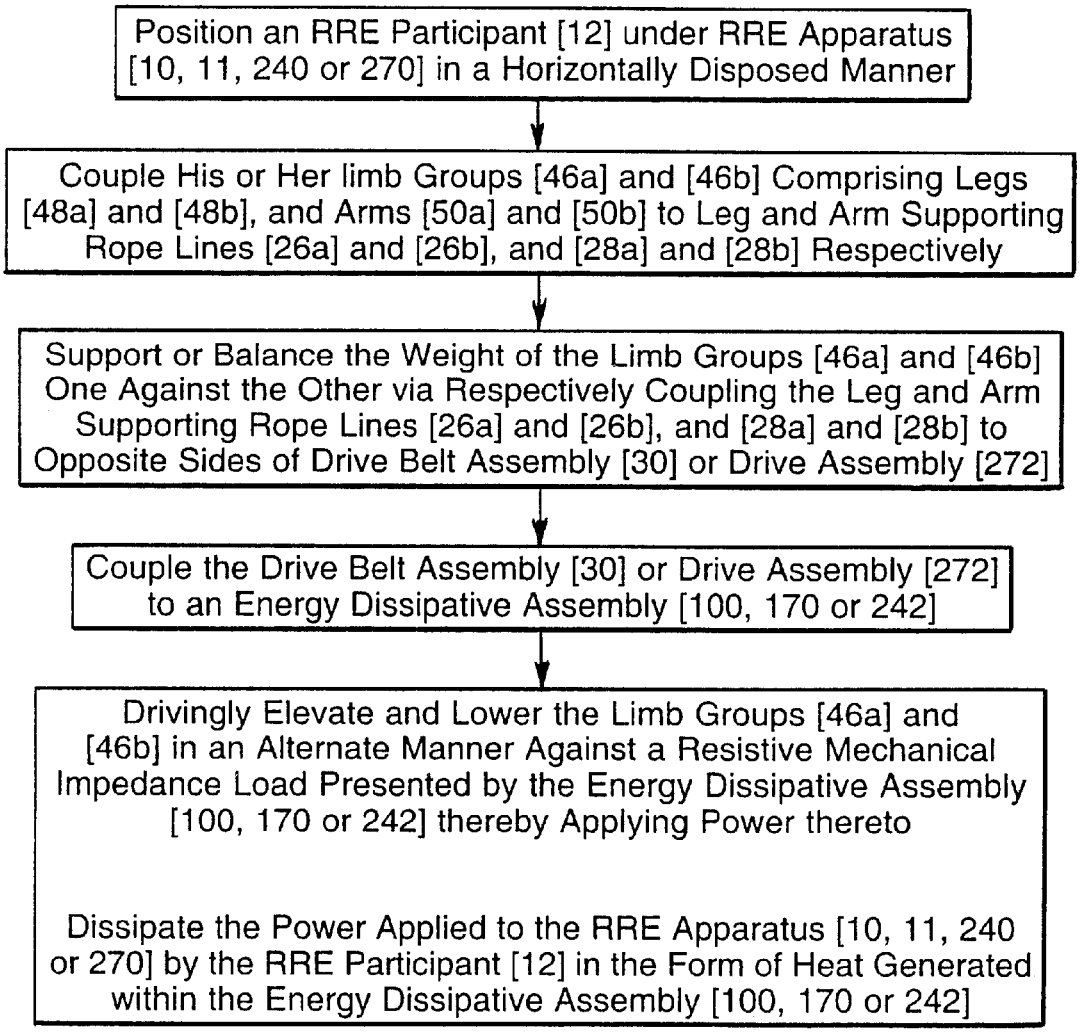
FIG. 9 is a flow chart depicting a method for enhancing physical activity and cardiovascular health enabled by utilization of apparatus of the present invention.

As depicted in a flow chart shown in FIG. 9, the preferred and the first and second alternate preferred embodiments of the present invention are all directed to a general method for enhancing physical activity and cardiovascular health through implementing RRE and dissipating applied power as heat. The method for enhancing physical activity and cardiovascular health comprises the steps of positioning a participant 12 under RRE apparatus 10, 11, 240 or 270; coupling his or her limb groups 46*a* and 46*b* to rope lines 26*a*, 26*b*, 28*a* and 28*b*; supporting or balancing the weight of the participant's limb groups 46*a* and 46*b* one against the other via oppositely coupling the leg and arm supporting rope lines 26*a*, 26*b*, 28*a* and 28*b* to drive belt assembly 30 or drive assembly 272; coupling the drive belt assembly 30 or drive assembly 272 to an energy dissipative assembly 100, 170 or 242; drivingly elevating and lowering the limb groups 46*a* and 46*b* in an alternate manner against a resistive mechanical impedance load presented by the energy dissipative assembly 100, 170 or 242 thereby applying power thereto; and dissipating the applied power as heat.

Having thus established the method for enhancing physical activity and cardiovascular health, and specifically having established the benefits of aerobic RRE in a qualitative manner, it is further desirable to quantitatively measure the running values of applied mechanical power and applied energy per session as applied by a participant 12 to any of the RRE apparatus 10, 11, 240 or 270. By way of example, the inventor is a six foot tall man who utilizes a 54 inch leg and 42.5 inch arm stroke at a rate of 40 up, and 40 down, strokes per minute of each limb group (e.g., 80 strides per minute) during RRE. On average, he can lift about 8 [lbs.] with each leg and 1.5 [lbs.] with each arm. He is somewhat stronger in the downward direction and can depress about 12 [lbs.] with each leg and 3 [lbs.] with each arm. This amounts to some 212 [ft.lbs.] of energy per round trip of both limb groups. At the 40 round trip per minute rate this means that he continuously applies power at an average of 8,475 [ft.lbs/min.] or 0.257 [horsepower] to an RRE apparatus 10 that he typically uses four or five times per week. At his present weight of 175 pounds, this is somewhat in excess of the power he would apply to a treadmill during stage 3 of a stress test. The difference is that he typically delivers that power aerobically to that RRE apparatus 10 for about 30 continuous minutes. Thus, his total energy delivery to that RRE apparatus 10 is about 254,250 [ft.lbs.] or about 63.5 [Calories] each exercise session. Again at his present weight of 175 pounds, this is equivalent to climbing about 1452 vertical feet, or about the height of the Sears Tower in Chicago in 30 minutes. Assuming his energy conversion efficiency to be about 15%, this means that he typically burns about 423 [Calories] of carbohydrate and fat derived energy each exercise session four or five times per week.

Figure 10A:
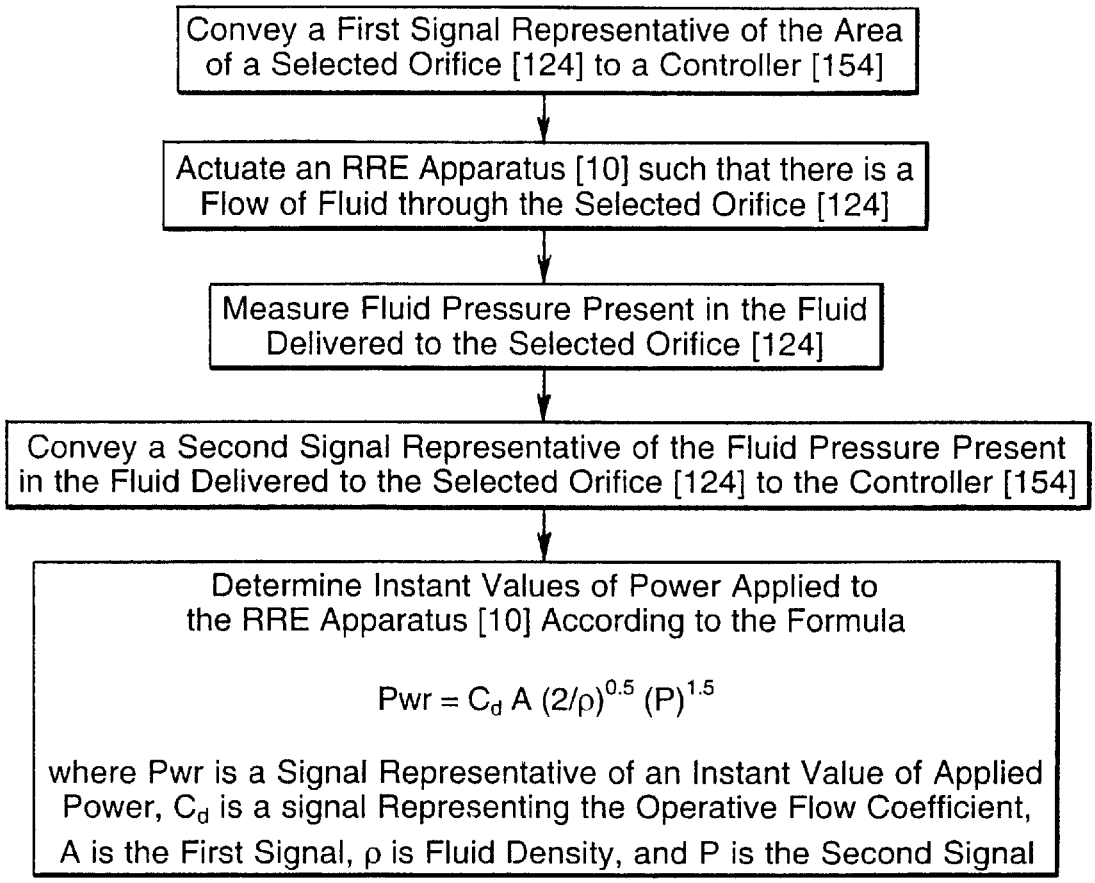
FIGS. 10A, 10B, 10C and 10D are flow charts depicting methods for measuring power applied to apparatus of the present invention.
Figure 10B:
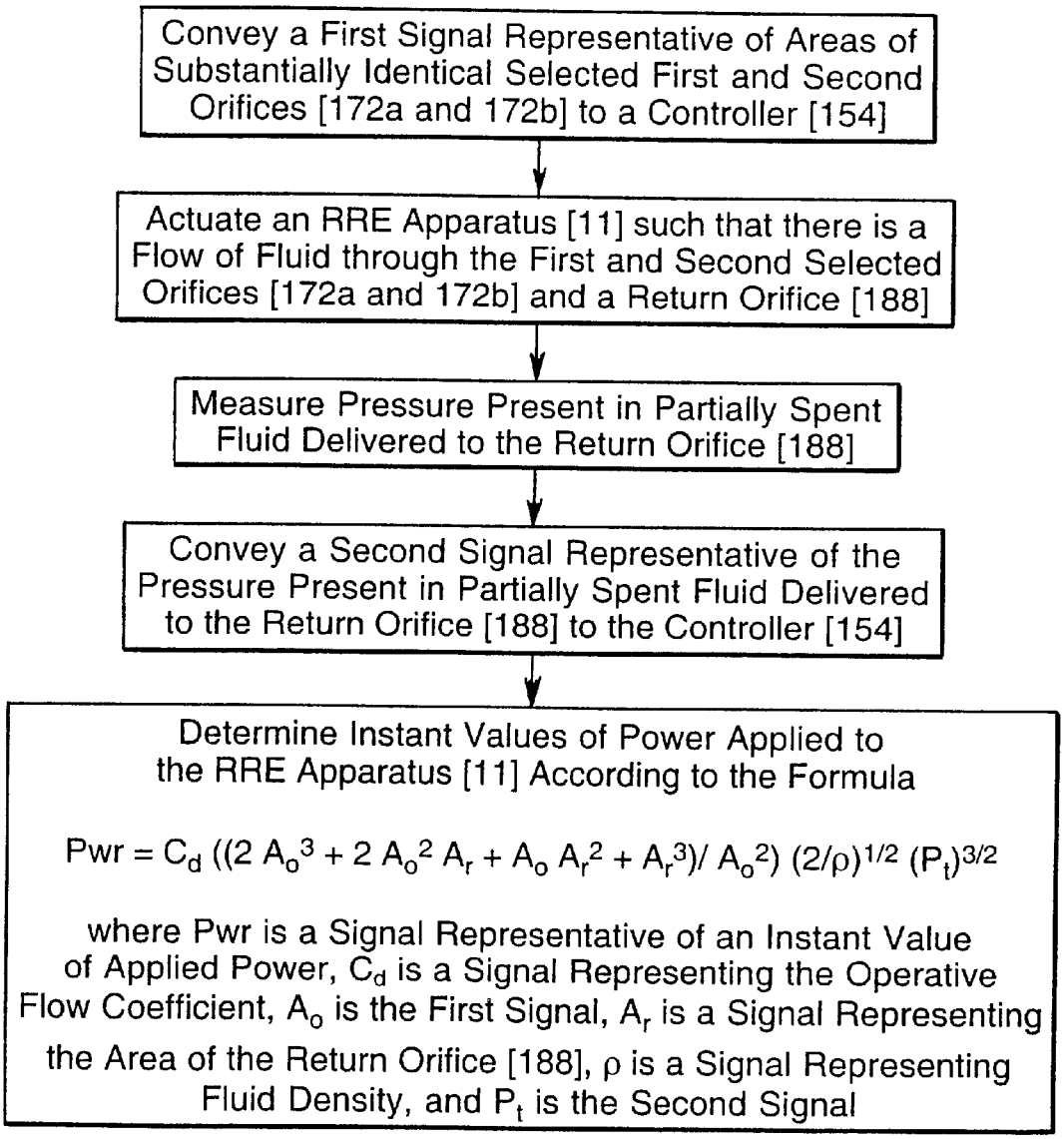

Instant values of power applied to either of energy dissipative hydraulic assemblies 100 or 170 by a participant 12 can respectively be determined in the controller 154 according to a method of determining instant values of applied power comprising measured pressure in fluid delivered to the selected orifice 124 of the energy dissipative hydraulic assembly 100 as depicted in a flow chart shown in FIG. 10A, or according to a method of determining instant values of applied power comprising measured pressure in fluid delivered to the return orifice 188 of the energy dissipative hydraulic assembly 170 as depicted in a flow chart in FIG. 10B. Alternately, power applied to either of energy dissipative hydraulic assemblies 100 or 170 can be determined in the controller 154 according to a method of determining running values of applied power comprising measured energy dissipative hydraulic assembly and ambient temperatures as depicted in a flow chart shown in FIG. 10C. Finally, instant values of power applied to energy dissipative electric assembly 242 can be determined in the controller 154 according to a method of determining instant values of applied power comprising measured voltage of electrical current delivered to the resistor bank 246 as depicted in a flow chart shown in FIG. 10D.

As depicted in FIG. 10A, the method for determining instant values of power applied to the RRE apparatus 10 (or an RRE apparatus 270 comprising energy dissipative hydraulic assembly 100) comprises the steps of conveying a first signal representative of the area of the selected orifice 124 to the controller 154; actuating the RRE apparatus 10 such that there is a flow of fluid through the selected orifice 124; measuring fluid pressure present in the fluid delivered to the selected orifice 124; conveying a second signal representative of fluid pressure present in the fluid delivered to the selected orifice 124 to the controller 154; and determining instant values of power applied to the RRE apparatus 10 according to the formula:

$$Pwr=C_dA(2/\rho)^{0.5}(P)^{1.5} \quad (1)$$

where Pwr is a signal representative of an instant value of applied power, $C_d$ is a signal representing the operative flow coefficient, A is the first signal, ρ is a signal representing fluid density, and P is the second signal, wherein the formula has been derived from the product of the formula for the flow rate through an orifice and the pressure drop across it.

As depicted in FIG. 10B, the method for determining instant values of power applied to the RRE apparatus 11 (or an RRE apparatus 270 comprising energy dissipative hydraulic assembly 170) comprises the steps of conveying a first signal representative of the areas of the substantially identical selected first and second orifices 172*a* and 172*b* to the controller 154; actuating the RRE apparatus 11 such that there is a flow of fluid through the selected first and second orifices 172*a* and 172*b* and the return orifice 188; measuring pressure present in the partially spent fluid delivered to the return orifice 188; conveying a second signal representative of pressure present in the partially spent fluid delivered to the return orifice 188 to the controller 154; and determining instant values of power applied to the RRE apparatus 11 according to the formula:

$$Pwr=C_d((2A_o^3+2A_o^2A_r+A_oA_r^2+A_r^3)/A_o^2)(2/\rho)^{1/2}(P_t)^{3/2} \quad (2)$$

where Pwr is a signal representative of an instant value of applied power, $C_d$ is a signal representing the operative flow coefficient, $A_o$ is the first signal, $A_r$ is a signal representing the area of the return orifice 188, ρ is a signal representing fluid density, and $P_t$ is the second signal, wherein the formula has generally been derived from the product of the equation for flow rate through orifices and the pressure drop across those orifices but is more complex as a result of the combined flows through those various orifices.

Figure 10C:
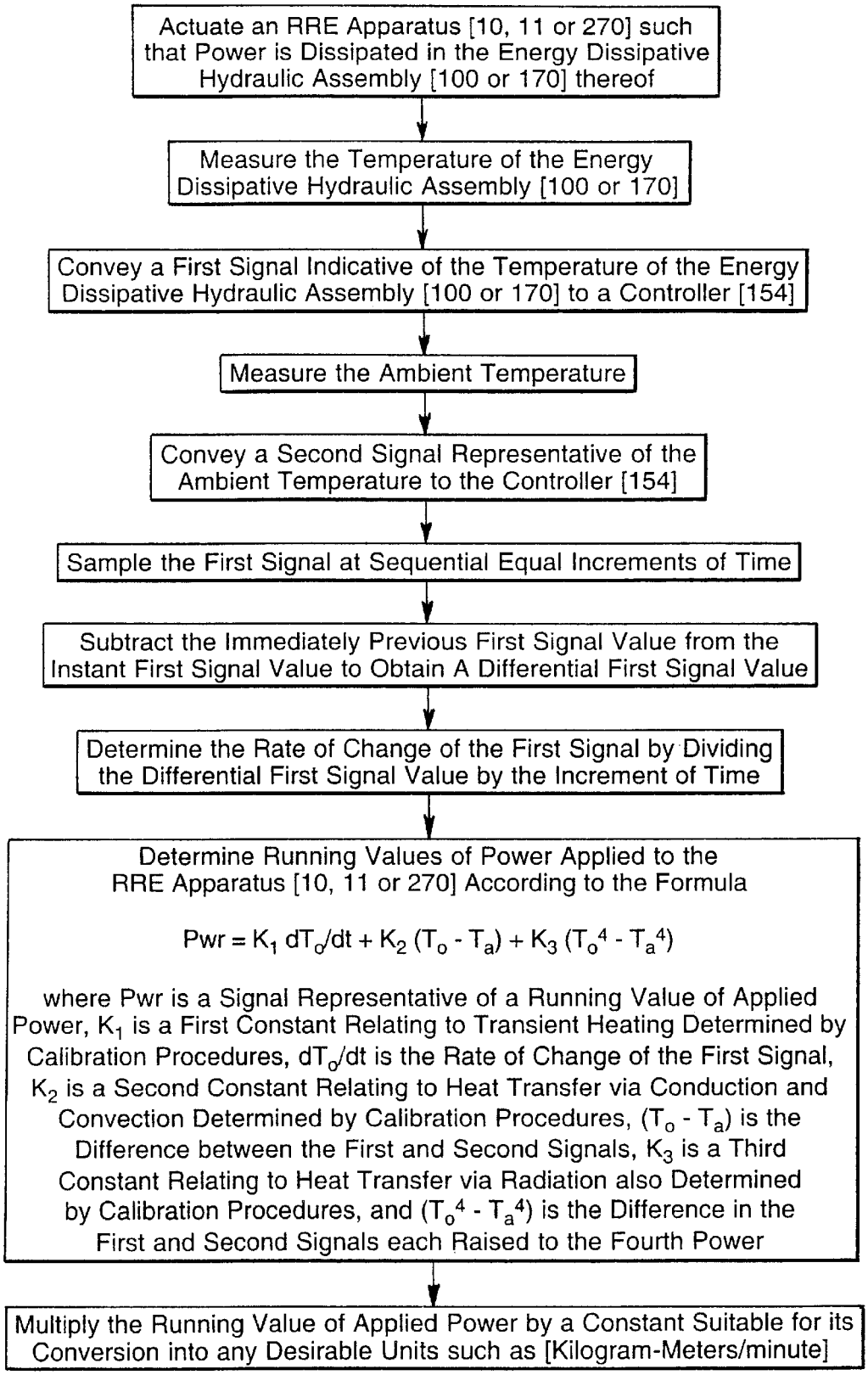

As depicted in FIG. 10C, the method for determining running values of applied power to any of RRE apparatus 10, 11 or 270 (e.g., comprising either of energy dissipative hydraulic assemblies 100 or 170) via utilizing measured energy dissipative hydraulic assembly and ambient temperatures comprises the steps of actuating the RRE apparatus 10, 11 or 270 such that there is a flow of fluid through the energy dissipative hydraulic assembly 100 or 170; measuring the temperature of the energy dissipative hydraulic assembly 100 or 170; conveying a first signal indicative of temperature the energy dissipative hydraulic assembly 100 or 170 to the controller 154; measuring the ambient temperature; conveying a second signal indicative of the ambient temperature to the controller 154; sampling the first signal at sequential equal increments of time; subtracting the immediately previous first signal value from the instant first signal value to obtain a differential first signal value; determining the rate of change the first signal by dividing the differential first signal value by the increment of time; determining running values of power applied to the RRE apparatus 10, 11 or 270 according to the formula $$Pwr=K_1dT_o/dt+K_2(T_o-T_a)+K_3(T_o^4-T_a^4) \quad (3)$$

where Pwr is a signal representative of a running value of applied power, $K_1$ is a first constant relating to transient heating determined by calibration procedures, $dT_o/dt$ is the rate of change of the first signal, $K_2$ is a second constant relating to heat transfer via conduction and convection determined by calibration procedures, $(T_o-T_a)$ is the difference between the first and second signals, $K_3$ is a third constant relating to heat transfer via radiation also determined by calibration procedures, and $(T_o^4-T_a^4)$ is the difference in the first and second signals each raised to the fourth power; and multiplying the running value of applied power by a constant suitable for its conversion into any desirable units such as Kilogram-Meters/minute.

Figure 10D:
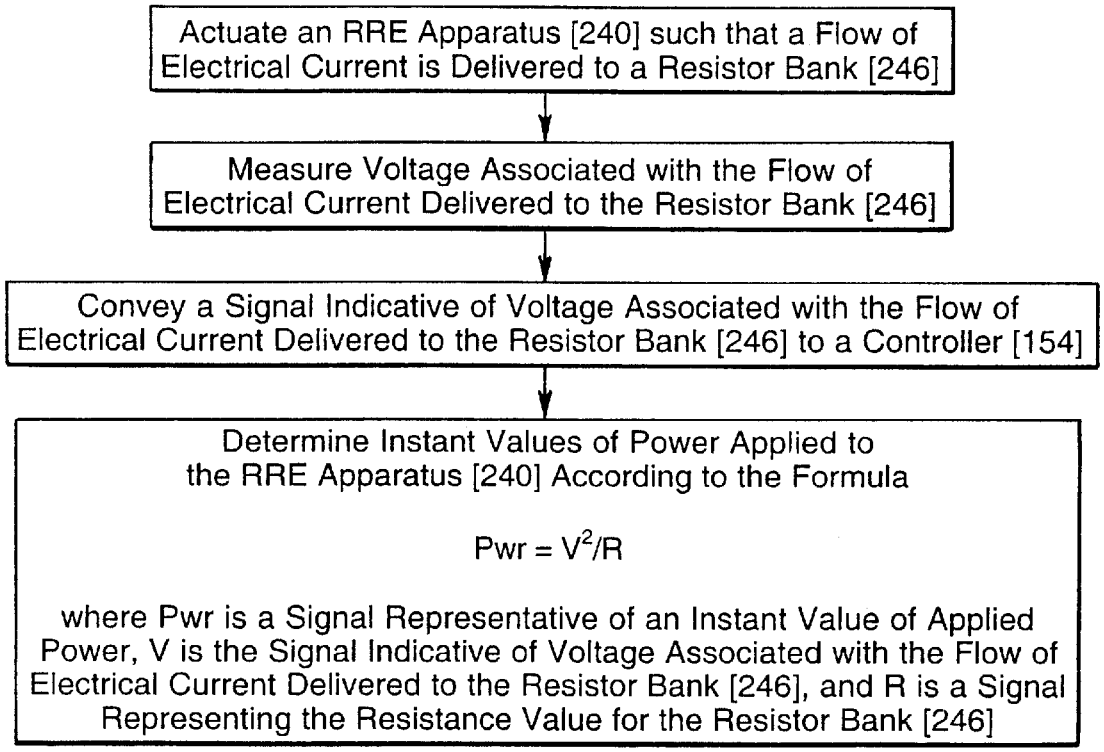

As depicted in FIG. 10D, the method for determining instant values of applied power to RRE apparatus 240 (e.g., to energy dissipative electric assembly 242) comprises the steps of actuating the RRE apparatus 240 such that a flow of electrical current is delivered to the resistor bank 246; measuring voltage associated with the flow of electrical current delivered to the resistor bank 246; conveying a signal representative of the voltage associated with the flow of electrical current delivered to the resistor bank 246 to the controller 154; and determining instant values of power applied to the RRE apparatus 240 according to the formula $$Pwr=V^2/R \quad (4)$$

where Pwr is a signal representative of an instant value of applied power, V is the signal indicative of voltage associated with the flow of electrical current delivered to the resistor bank 246, and R is a signal representing the resistance value for the resistor bank 246.

Figure 11:
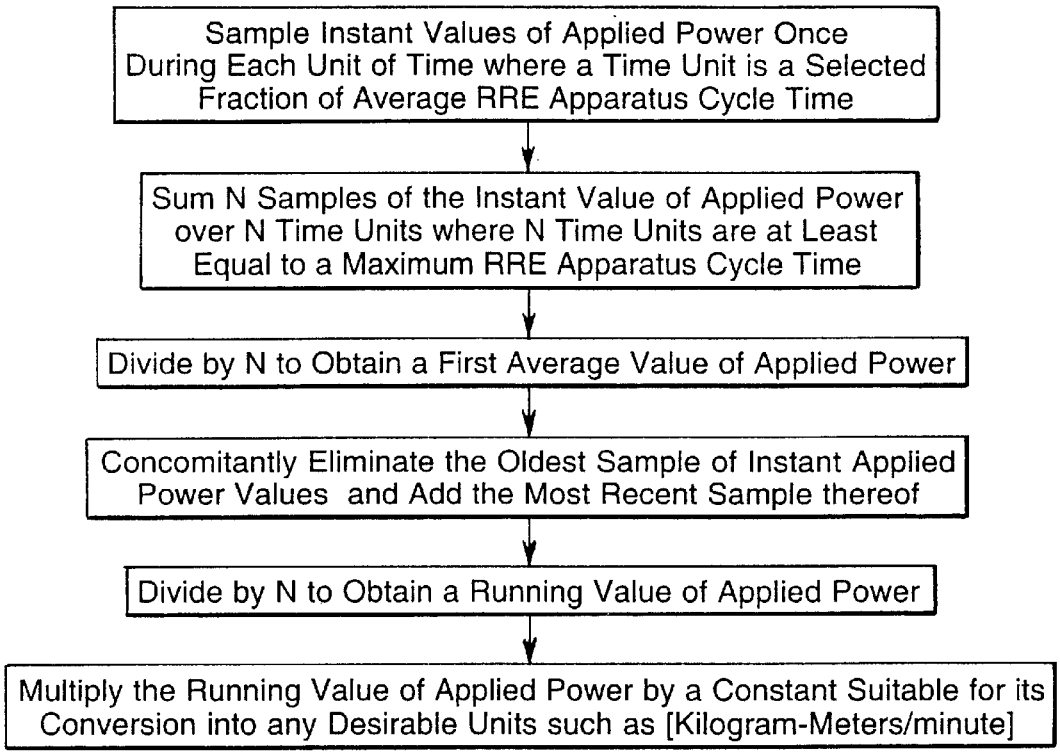
FIG. 11 is a flow chart depicting a method for generating running values of power applied to RRE apparatus of the present invention.

As depicted in FIG. 11, a method for generating running values of power applied to an RRE apparatus 10, 11, 240 and 270 in conjunction with the methods for determining instant values of power applied to RRE apparatus as depicted in FIGS. 10A, 10B and 10D comprises the steps of sampling instant values of applied power once during each unit of time where a time unit is a selected fraction of average RRE apparatus cycle time; summing the first N samples of instant applied power values over N time units where N time units are at least equal to a maximum RRE apparatus cycle time; dividing by the number N to obtain a first average value of applied power; concomitantly eliminating the oldest sample of instant applied power values and adding the most recent sample thereof; dividing by the number N to obtain the running value of applied power; and multiplying the running value of applied power by a constant suitable for its conversion into any desirable units such as Kilogram-Meters/minute.

Figure 12:
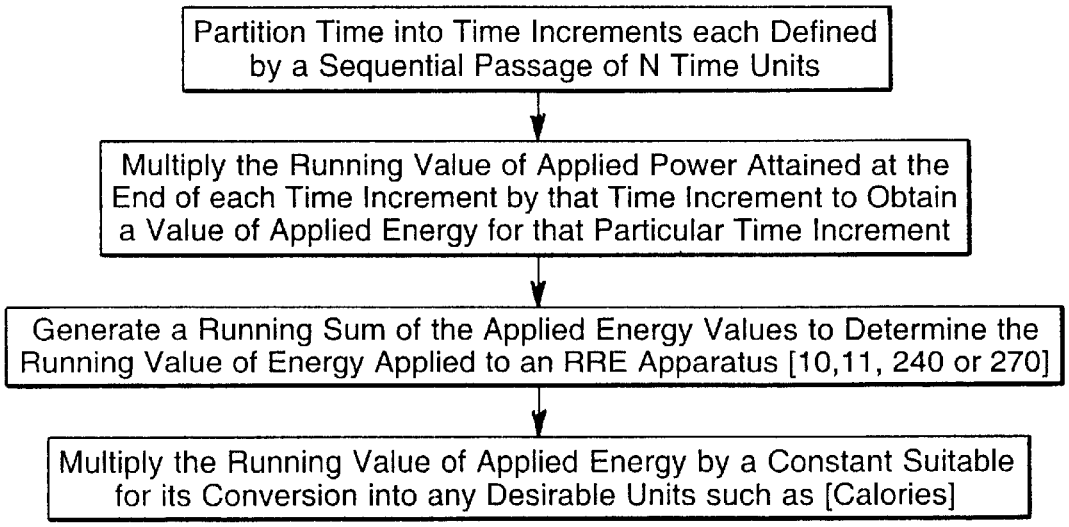
FIG. 12 is a flow chart depicting a method for generating a value for energy applied to RRE apparatus of the present invention.

As depicted in FIG. 12, a method for generating a running applied energy value for energy applied to an RRE apparatus 10, 11, 240 and 270 in conjunction with the methods for determining running values of power applied to an RRE apparatus as depicted in FIGS. 10C and 11 comprises the steps of partitioning time into time increments each defined by a sequential passage of N time units; multiplying the running value of applied power attained at the end of each time increment by that time increment to obtain a value of applied energy for that particular time increment; generating a running sum of the applied energy values to determine the running value of energy applied to the RRE apparatus; and multiplying the running value of applied energy by a constant suitable for its conversion into any desirable units such as Calories.

Figure 13:
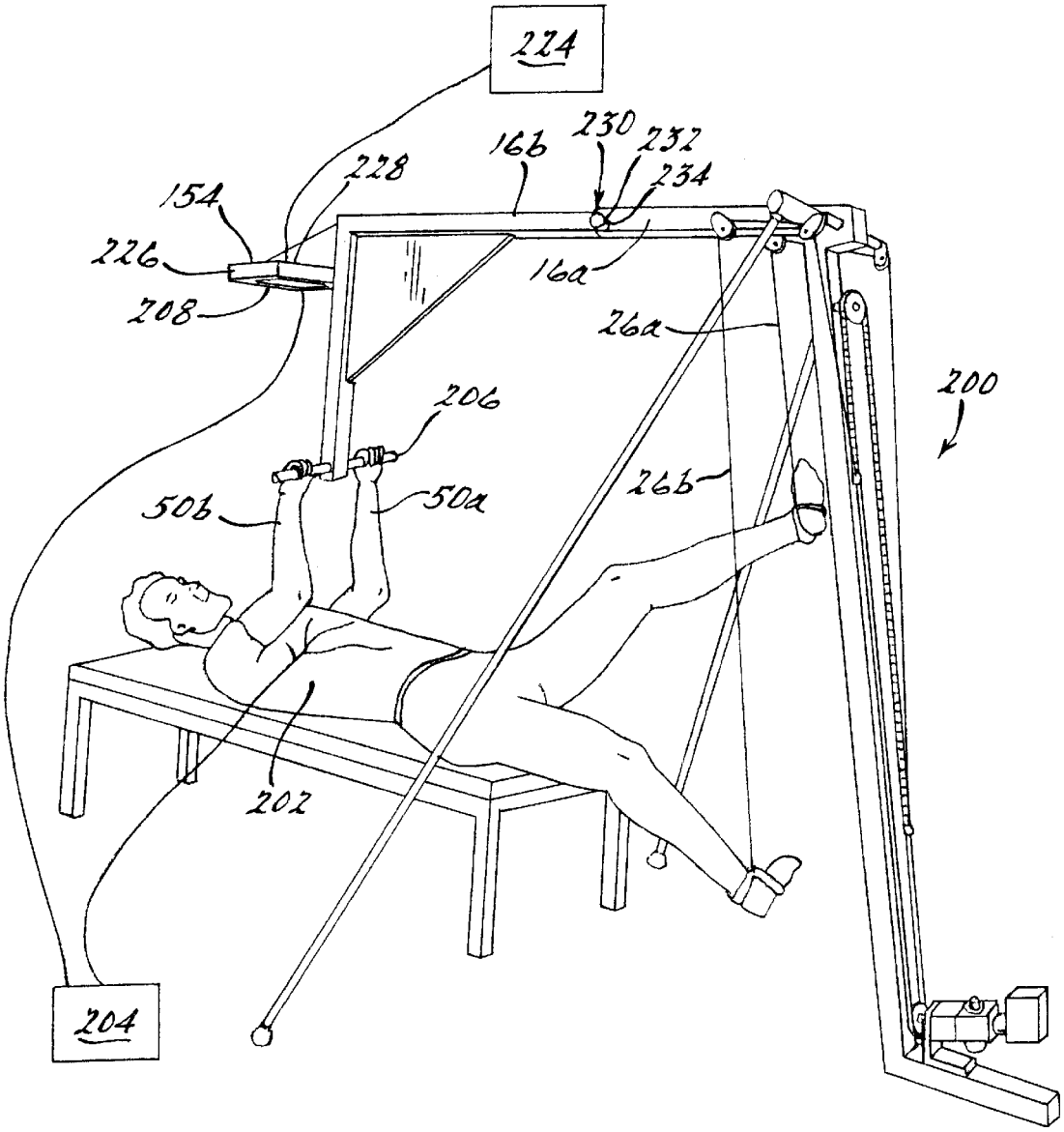
FIG. 13 is a partially schematic perspective view of RRE apparatus according to a fourth alternative preferred embodiment of the present invention wherein a heart patient is depicted undergoing a cardiovascular stress test.

As mentioned above, the relatively severe oxygen debt engendered by a stress test is similar to that commonly resulting from normally discouraged activities such as shoveling snow. Overcoming the resulting effects can require a significant recovery period and set back even an experienced participant's conditioning program significantly. This is largely due to the vastly improved performance levels of which the experienced participant 12 is capable. In the example cited hereinabove, the inventor delivered additional power to the treadmill in the amount of 0.449 [horsepower] for 3 minutes in comparison with his prior stress test performance. This amounted to an extra 44,450 [ft. lbs.] or about 14.4 [Calories] of energy delivered to the treadmill. The problem with this is that the body is quite inefficient under the required conditions of rapid leg movement up a steep incline. Further, this extra energy was required under anaerobic conditions wherein the chemical energy source was inefficient utilization of decomposing muscle tissue. Assuming a drastically reduced energy conversion efficiency of 5%, the inventor's body was required to provide additional anaerobic energy in the order of 290 [Calories] during a time period of only 3 minutes. Now, in spite of his improved condition (and stress test performance), he was still a 66 year old heart patient whereby such an abrupt anaerobic energy expenditure constituted quite a shock. Because of the underlying risk factors evidenced by this example, an improved method for cardiovascular stress testing is proposed as follows:

With reference to FIG. 13, depicted is an RRE apparatus 200 utilized for enabling an improved method for cardiovascular stress testing of a heart patient 202 according to a fourth alternate preferred embodiment of the present invention. Although RRE apparatus 10 or 11 is depicted in FIG. 13 as the structural basis for RRE apparatus 200, either of RRE apparatus 240 or RRE apparatus 270 could be utilized for RRE apparatus 200 instead. In any case, electrocardiographic equipment 204 is connected to the heart patient 202 as in present stress testing. Depending upon the RRE apparatus chosen as a basis for RRE apparatus 200, an appropriate method of determining applied power and energy is also utilized as described above. However, it is necessary to eliminate the gross motion of the arms 50*a* and 50*b* because chest muscle activation tends to disturb electrical impulses required for collecting electrocardiographic data. Thus, the arm supporting rope lines 28*a* and 28*b* are eliminated and replaced by a hand bar 206 for the heart patient 202 to hold on to and achieve stability as he or she exerts the required leg forces on RRE apparatus 200. The overhead supporting member 16 is configured as two telescoping members 16*a* and 16*b* in order to accommodate heart patients 202 of differing heights where the telescoping member 16*b* is retained in a selected position with a clamping knob 230 comprising a threaded stud 232 inserted into a suitable weld nut 234 mounted on the telescoping member 16*a* and bearing on the telescoping member 16*b*.

The improved method for cardiovascular stress testing is believed herein to be beneficial for the well being of heart patients during stress testing because equivalent cardiovascular work loads can be attained at lower blood pressure and pulse rate values. In part, this is because of the larger stroke volumes attained with the torso horizontally disposed in the manner described above. In fact, it is strongly suspected herein that ischemia will show up at lower cardiovascular work loads because of the larger stroke volumes. This is because the myocardium will be further dilated and the coronary arteries physically manipulated to a greater extent during RRE than during normal treadmill exercise even though the pulse rate will in general be lower. This should result in the necessary information for ischemic heart patients being obtained at lower stress levels. Thus, stress testing of ischemic heart patients would likely be terminated at lower stress levels.

In addition, the above described method of cardiovascular stress testing is better balanced with respect to a particular heart patient's anatomical differences. Although a taller heart patient will probably have a longer leg stroke, a shorter heart patient of the same weight will presumably have more leverage and thus be able to generate higher leg forces. These factors serve to balance one another with the result that heart patients' output performance levels are more directly comparable.

During the above described stress testing it is quite possible that a heart patient 202 might exceed his or her aerobic RRE limit and enter anaerobic exercise. As a matter of fact, in the case of a truly compromised heart patient being evaluated for heart transplant, anaerobic exercise would normally be encountered at very low levels of exercise intensity. In this case, it is desirable to utilize exhaled breath analysis for detecting such a transition to anaerobic exercise precisely. Thus, in some cases respiration analysis equipment would be utilized in conjunction with the RRE apparatus 200 in addition to the standard electrocardiographic equipment.

In any case, in implementing the improved method for cardiovascular stress testing a coefficient of performance (hereinafter "COP") for applied power is utilized. As defined herein, a nominal COP value of 100% is based upon the assumed ability of an average healthy 150 pound human to continuously deliver an average applied power value of 0.1 [horsepower] or 3300 [ft.lbs./min.]. In order to standardize results, COP values for any particular heart patient 202 must reflect that heart patient's weight. In implementing COP values for a particular heart patient 202, actual applied power values delivered by that heart patient are multiplied by the product of 100 [%] and the ratio of 150 [lbs.]/3300 [ft.lbs./min.] and divided by his or her weight. Thus, the heart patient's actual COP is determined by the formula $$COP=4.545(Pwr/Wt) \quad (5)$$

where 4.545 is the numerical value of (100 150)/3300 (in [%min./ft.]), Pwr is the moving average value of applied power (in [ft.lbs./min.]) and Wt is the heart patient's weight (in [lbs.]). For instance, the 175 pound inventor would have to deliver applied power at (100 175)/4.545=3,850 [ft.lbs./min.]=87 [watts]=0.117 [horsepower]=532 [Kilogram-Meters/min.], or alternately, at a rate of 75 Cal./Hour in order to achieve a COP of 100%. Using his above derived actual applied average power of 8,475 [ft.lbs./min.] in the above formula results in a COP of 220%. Remembering that this applied average power value is maintained for 30 minutes, it seems reasonable that he could indeed be expected to achieve a COP of 100% continuously.

Of course, running COP values determined according to equation (5) above and running energy values determined according to the steps depicted in FIG. 12 can be utilized for any participant in conjunction with any of the RRE apparatus 10, 11, 240 and 270 as well—at least as an available option. Although not depicted in the various figures pertaining thereto, the controller 154 comprising a read out display 208 (e.g., less the serial port 228) is indeed offered as an option for any of the RRE apparatus 10, 11, 240 and 270.

Figure 14:
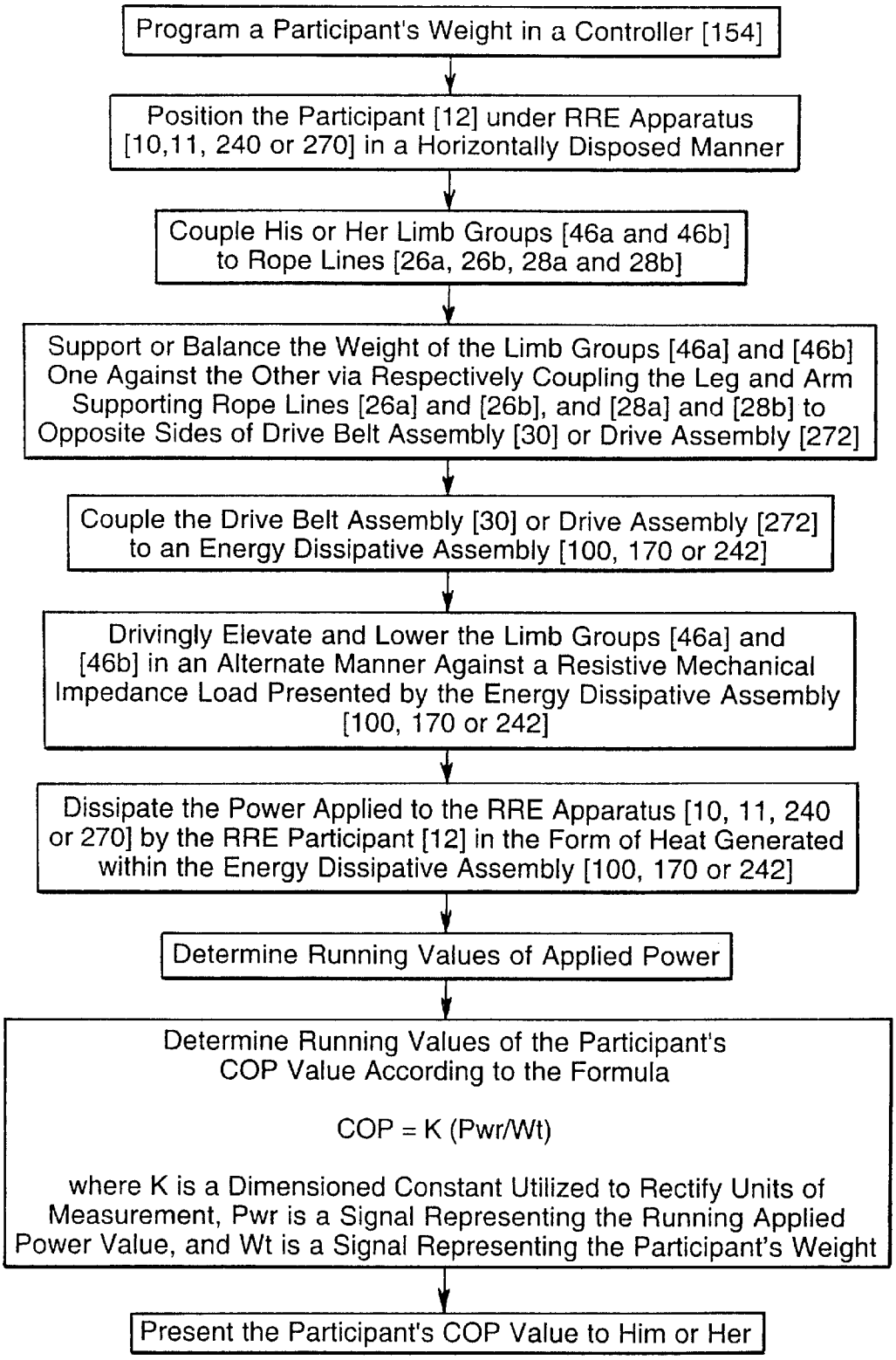
FIG. 14 is a flow chart depicting a method for determining a coefficient of performance for a participant utilizing apparatus of the present invention.

As specifically depicted in the flow chart shown in FIG. 14, a method for determining COP for a horizontally disposed participant utilizing any of the RRE apparatus 10, 11, 240 and 270 comprises the steps of: programming the participant's weight in the controller; positioning the participant under the RRE apparatus in a horizontally disposed manner; coupling the horizontally disposed participant's limb groups to the rope lines; supporting or balancing the weight of the limb groups one against the other via respectively coupling the rope lines to opposite sides of the drive assembly; coupling the drive assembly to the energy dissipative assembly; drivingly elevating and lowering the limb groups in an alternate manner against a resistive mechanical impedance load presented by the energy dissipative assembly thereby applying power thereto; dissipating the applied power as heat; determining running values of applied power; determining running values of the participant's COP according to the formula $$COP=K(Pwr/Wt)$$

where K is a dimensioned constant utilized to rectify units of measurement (e.g., 4.545 [%min./ft.] in the English units used above), Pwr is a signal representing the running applied power value and Wt is a signal representing the participant's weight; and presenting the participant's COP value to him or her.

Figure 15:
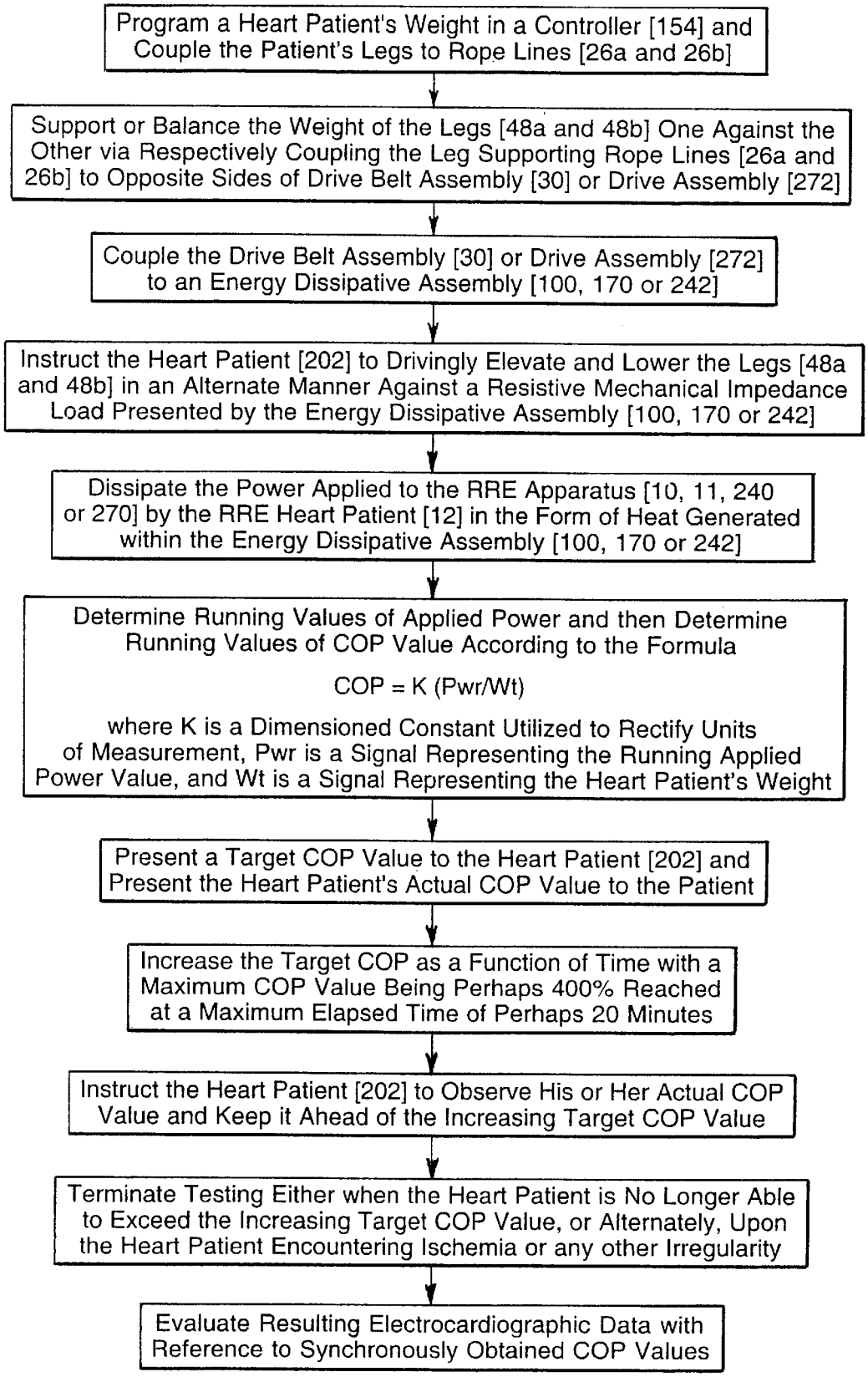
FIG. 15 is a flow chart depicting an improved method for cardiovascular stress testing according to the fourth alternate preferred embodiment of the present invention.

And as specifically depicted in the flow chart shown in FIG. 15, the improved method for cardiovascular stress testing comprises the steps of programming the heart patient's weight in the controller; hooking up the heart patient to the electrocardiographic equipment; positioning the heart patient under the RRE apparatus in a horizontally disposed manner; coupling the horizontally disposed heart patient's legs to the rope lines; supporting or balancing the weight of the legs one against the other via respectively coupling the rope lines to opposite sides of the drive assembly; coupling the drive assembly to the energy dissipative assembly; instructing the heart patient to drivingly elevate and lower his or her legs in an alternate manner against a resistive mechanical impedance load presented by the energy dissipative assembly thereby applying power thereto; dissipating the applied power as heat; determining running values of applied power; determining running values of the heart patient's COP according to the formula $$COP=K(Pwr/Wt)$$

where K is a dimensioned constant utilized to rectify units of measurement (e.g., 4.545 [%min./ft.] in the English units used above), Pwr is a signal representing the running applied power value and Wt is a signal representing the heart patient's weight; presenting a target COP value to the heart patient; presenting the heart patient's actual COP value to him or her; increasing the target COP value as a function of time with a maximum target COP value being perhaps 400%

(e.g., a value close to that attained during stage 6 of present treadmill stress tests) reached at a maximum time of perhaps 20 minutes; instructing the heart patient to observe his or her actual COP value and keep it ahead of the increasing target COP value by exercising in a progressively more vigorous manner via higher repetition rates and/or longer stroke length; terminating testing either when the heart patient is no longer able to exceed the increasing target COP value, or alternately, upon the heart patient encountering ischemia or any other irregularity; and evaluating resulting electrocardiographic data with reference to synchronously obtained COP values.

With reference now to FIG. 16, a read out display 208 utilized for displaying the information described above with reference to applied power measurement is there shown. A participant 12 or heart patient 202 observes target and actual COP read outs 210 and 212, respectively, along with weight, session time, applied power and session energy read outs 214, 216, 218 and 220, respectively while he or she performs RRE. For convenience, the read out display 208 may be mounted via a bracket 222 under the overhead supporting member 16 of the tripod structure 14 as shown in FIG. 13. The read out display 208 may be presented upon a liquid crystal display associated with an external computer 224 utilized for performing the functions of the controller 154. Alternately, a controller 154 comprising a front panel featuring the read out display 208 may be packaged in an enclosure 226. In this case, a serial port 228 may be provided for connection to the external computer 224 or the electrocardiographic equipment 204.

Again, the RRE method has been found to enable improved physical and cardiovascular health through true aerobic exercise at high applied power levels. Indeed, for athletes interested in improving their running skills, the RRE method has been found to enhance muscle development, especially fast twitch muscles that enable improved running speed. Further, the RRE method has been found to be protective against leg strain and pulled hamstring muscles in succeeding track workouts and races.

Again, these factors are thought to be enabled because of low blood pressure values commonly observed during RRE. As has been thoroughly described above, it is believed herein that the reason for this is that RRE involves exercise conducted with the torso horizontally disposed and the limbs averagely elevated in a manner wherein first muscle groups are stressed while complementary muscle groups relax and then the complementary muscle groups are stressed while the first muscle groups relax. This is important because alternately relaxing all muscle tissue permits blood flow therethrough at least part of the time thus implying more efficient capillary utilization and resulting in true aerobic exercise on a microscopic level.

Having described the invention, however, many modifications thereto will become immediately apparent to those skilled in the art to which it pertains, without deviation from the spirit of the invention. This is especially true with regard to specific component choices. For instance, other types of mechanical linkages, pumping equipment or power transmission means could be utilized instead of those depicted in the various figures. Such modifications clearly fall within the scope of the invention.

Commercial Applicability

The instant RRE apparatus is capable of providing improved cardiovascular health and/or physical conditioning at significantly reduced costs to significant portions of the population, and accordingly finds commercial application in the health and fitness industries both in America and abroad.

What is claimed is:

1. An exercise apparatus, hereinafter referred to as RRE apparatus, for use by a horizontally disposed participant in implementing an exercise wherein each limb extremity of the horizontally disposed participant is coupled to the RRE apparatus by a pair of pulleys supported by flexible lines, one of the pair connected to a first limb group including a left leg and a right arm of the participant, and an other of the pair connected to a second limb group including a right leg and a left arm of the participant, the RRE apparatus comprising:

a drive assembly coupled to the lines wherein the limbs are constrained for alternate elevation and lowering of the first limb group and the second limb group;

an energy dissipative assembly coupled to the drive assembly;

a combining and supporting structure; and the structure for nominally supporting or balancing the weight of the horizontally disposed participant's first and second limb groups one against the other such that the participant is able to alternately apply lifting force to the first limb group while pulling down on the second limb group and then lifting force to the second limb group while pulling down on the first limb group, and for dissipating power applied by the participant while the participant elevates and lowers the first and second limb groups in an alternate rhythmic manner.

2. The RRE apparatus of claim 1 wherein the drive assembly utilized to couple the lines to the energy dissipative assembly comprises respective leg and arm drive sprockets respectively driven by leg and arm drive belts coupled on either side thereof to respective left and right leg and arm supporting ones of the lines.

3. The RRE apparatus of claim 1 wherein the energy dissipative assembly is an energy dissipative hydraulic assembly additionally comprising:

a reversible pump having first and second pump ports for receiving power applied to the lines by the participant and generating a flow of pressurized fluid in response thereto, either one of the first and second pump ports delivering the flow of pressurized fluid and the other one receiving a similar flow of fluid depending upon the direction of rotational motion thereof;

a selected orifice;

a fluid reservoir;

a valve assembly for directing pressurized fluid delivered from either of the first or second pump ports to and through the selected orifice t o the reservoir; and first and second check valve assemblies respectively fluidly coupled between the reservoir and the first and second pump ports for returning the similar flow of fluid from the reservoir to the fluid receiving one of the first and second pump ports.

4. The RRE apparatus of claim 3 wherein the energy dissipative hydraulic assembly additionally comprises means for generating a first signal indicative of the area of the selected orifice, a pressure transducer fluidly coupled to the valve assembly for generating a second signal indicative of the fluid pressure of the pressurized fluid delivered to the selected orifice, and a controller for determining instant values of power applied to the RRE apparatus based upon the first and second signals.

5. The RRE apparatus of claim 1 wherein the energy dissipative assembly is an energy dissipative hydraulic assembly additionally comprising:

a reversible pump having first and second pump ports for receiving power applied to the lines by the participant and generating a flow of pressurized fluid in response thereto, either one of the first and second pump ports delivering the flow of pressurized fluid and the other one receiving a similar flow of fluid depending upon the direction of rotational motion thereof;

substantially identical first and second selected orifices, each respectively fluidly coupled to the first and second pump ports for receiving and transmitting the flow of pressurized fluid from either of the first and second pump ports;

a fluid reservoir;

a common passage fluidly coupled between the first and second orifices and the fluid reservoir for receiving the flow of fluid from either of the first and second selected orifices as partially spent fluid and delivering at least a portion thereof to the fluid reservoir; and first and second check valve assemblies respectively fluidly coupled between the reservoir and the first and second pump ports for returning the similar flow of fluid from the reservoir to the fluid receiving one of the first and second pump ports.

6. The RRE apparatus of claim 5 wherein the energy dissipative hydraulic assembly additionally comprises means for generating a first signal indicative of the areas of the substantially identical first and second selected orifices, a return orifice for receiving the portion of partially spent fluid and then delivering it to the reservoir as totally spent fluid, a pressure transducer fluidly coupled to the common passage for generating a second signal indicative of the fluid pressure present in the partially spent fluid delivered to the return orifice, and a controller for determining instant values of power applied to the RRE apparatus based upon the first and second signals.

7. The RRE apparatus of claim 1 wherein the energy dissipative assembly is an energy dissipative hydraulic assembly and the RRE apparatus additionally comprises:

a first temperature transducer for measuring the temperature of the energy dissipative hydraulic assembly and providing a first signal indicative thereof;

a second temperature transducer for measuring ambient temperature and providing a second signal indicative thereof;

a controller for determining instant values of power applied to the RRE apparatus based upon the first and second signals.

8. The RRE apparatus of claim 1 wherein the energy dissipative assembly is an energy dissipative electric assembly additionally comprising:

electrical generating apparatus for receiving power applied to the lines by the participant and generating a flow of electrical current in response thereto; and a resistor bank for receiving the flow of electrical current.

9. The RRE apparatus of claim 8 wherein the energy dissipative electric assembly additionally comprises a voltage transducer electrically coupled to the resistor bank for generating a signal indicative of the voltage associated with the flow of electrical current delivered to the resistor bank, and a controller for determining instant values of power applied to the RRE apparatus based upon the signal.

10. The RRE apparatus of claim 1 wherein the RRE apparatus is semi-portable RRE apparatus additionally comprising:

a hub;

respective leg and arm supporting reels coupled to the lines and commonly mounted upon the hub;

power transmission means for drivingly coupling the hub to the energy dissipative assembly; and an elevated housing supported above the horizontally disposed participant via a horizontal member and tripod legs for commonly mounting the hub, leg and arm supporting reels, energy dissipative assembly and other functional components in a compact manner.

11. A method for enhancing physical activity and cardiovascular health of a horizontally disposed participant utilizing an RRE apparatus wherein the method comprises the steps of:

positioning the participant under the RRE apparatus in a horizontally disposed manner;

coupling a first limb group including a left leg and right arm of the participant to a first flexible line and coupling a second limb group including a right leg and a left arm of the participant to a second flexible line;

supporting or balancing the weight of the limb groups one against the other via respectively coupling the first and second lines to opposite sides of the drive assembly;

coupling the drive assembly to the energy dissipative assembly;

drivingly elevating and lowering the limb groups in an alternate manner against a resistive mechanical impedance load presented by the energy dissipative assembly thereby applying power thereto; and dissipating the applied power as heat.

12. A method for determining instant values of power applied to the RRE apparatus of claim 11 wherein the method comprises the steps of:

conveying a first signal representative of the area of the selected orifice to the controller;

actuating the RRE apparatus such that there is a flow of fluid through the selected orifice;

measuring fluid pressure present in the fluid delivered to the selected orifice;

conveying a second signal representative of fluid pressure present in the fluid delivered to the selected orifice to the controller; and determining instant values of power applied to the RRE apparatus according to the formula $$Pwr=C_dA(2/\rho)^{0.5}(P)^{1.5}$$

where Pwr is a signal representative of an instant value of applied power, $C_d$ is a signal representing the operative flow coefficient, A is the first signal, ρ is a signal representing fluid density, and P is the second signal.

13. A method for determining instant values of power applied to the RRE apparatus of claim 12 wherein the method comprises the steps of:

conveying a first signal representative of the areas of the substantially identical selected first and second orifices to the controller;

actuating the RRE apparatus such that there is a flow of fluid through the selected first and second orifices and the return orifice;

measuring pressure present in the partially spent fluid delivered to the return orifice;

conveying a second signal representative of pressure present in the partially spent fluid delivered to the return orifice to the controller; and determining instant values of power applied to the RRE apparatus according to the formula $$Pwr=C_d((2A_o^3+2A_o^2A_r+A_oA_r^2+A_r^3)/A_o^2)(2/\rho)^{1/2}(P_t)^{3/2}$$

where Pwr is a signal representative of an instant value of applied power, $C_d$ is a signal representing the operative flow coefficient, $A_o$ is the first signal, $A_r$ is a signal representing the area of the return orifice, ρ is a signal representing fluid density, and $P_t$ is the second signal.

14. A method for determining running values of power applied to an RRE apparatus of claim 11 wherein the method comprises the steps of:

actuating the RRE apparatus such that power is dissipated in the energy dissipative hydraulic assembly;

measuring the temperature of the energy dissipative hydraulic assembly;

conveying a first signal indicative of the temperature of the energy dissipative hydraulic assembly to the controller;

measuring the ambient temperature;

conveying a second signal indicative of the ambient temperature to the controller;

sampling the first signal at sequential equal increments of time;

subtracting the immediately previous first signal value from the instant first signal value to obtain a differential first signal value;

determining the rate of change of the first signal by dividing the differential first signal value by the increment of time;

determining running values of power applied to the RRE apparatus according to the formula $$Pwr=K_1dT_o/dt+K_2(T_o-T_a)+K_3(T_o^4-T_a^4)$$

where Pwr is a signal representative of a running value of applied power, $K_1$ is a first constant relating to transient heating determined by calibration procedures, $dT_o/dt$ is the rate of change of the first signal, $K_2$ is a second constant relating to heat transfer via conduction and convection determined by calibration procedures, $(T_o-T_a)$ is the difference between the first and second signals, $K_3$ is a third constant relating to heat transfer via radiation also determined by calibration procedures, and $(T_o^4-T_a^4)$ is the difference in the first and second signals each raised to the fourth power; and multiplying the running value of applied power by a constant suitable for its conversion into any desirable units such as Kilogram-Meters/minute.

15. A method for determining instant values of power applied to the RRE apparatus of claim 11 wherein the method comprises the steps of:

actuating the RRE apparatus such that a flow of electrical current is delivered to the resistor bank;

measuring voltage associated with the flow of electrical current delivered to the resistor bank;

conveying a signal indicative of voltage associated with the flow of electrical current delivered to the resistor bank to the controller; and determining instant values of power applied to the RRE apparatus according to the formula $$Pwr=V^2/R$$

where Pwr is a signal representative of an instant value of applied power, V is the signal indicative of voltage associated with the flow of electrical current delivered to the resistor bank, and R is a signal representing the resistance value for the resistor bank.

16. A method for determining running values of power applied to an exercise RRE apparatus in conjunction with a method for determining instant values of power applied to RRE apparatus, the apparatus for use by a horizontally disposed participant in implementing an exercise wherein each limb extremity of the horizontally disposed participant is coupled to the RRE apparatus by a pair of pulleys supported by flexible lines, one of the pair connected to a first limb group including a left leg and a right arm of the participant, an other of the pair connected to a second limb group including a right leg and a left arm of the participant wherein the method comprises the steps of:

sampling instant values of applied power once during each unit of time where a time unit is a selected fraction of average RRE apparatus cycle time;

summing the first N samples of instant applied power values over N time units where N time units are at least equal to a maximum RRE apparatus cycle time;

dividing by the number N to obtain a first average value of applied power;

concomitantly eliminating the oldest sample of instant applied power values and adding the most recent sample thereof;

dividing by the number N to obtain the running value of applied power; and multiplying the running value of applied power by a constant suitable for its conversion into any desirable units such as Kilogram-Meters/minute.

17. A method for determining a running applied energy value of energy applied to an RRE exercise apparatus in conjunction with a method for determining running values of power applied to an RRE apparatus, the apparatus for use by a horizontally disposed participant in implementing an exercise wherein each limb extremity of the horizontally disposed participant is coupled to the RRE apparatus by a pair of pulleys supported by flexible lines, one of the pair connected to a first limb group including a left leg and a right arm of the participant, an other of the pair connected to a second limb group including a right leg and a left arm of the participant wherein the method comprises the steps of:

partitioning time into time increments each defined by a sequential passage of N time units;

multiplying the running value of applied power attained at the end of each time increment by that time increment to obtain a value of applied energy for that particular time increment;

generating a running sum of the applied energy values to determine the running value of energy applied to the RRE apparatus; and multiplying the running value of applied energy by a constant suitable for its conversion into any desirable units such as Calories.

18. The RRE apparatus of claim 1 wherein the RRE apparatus additionally comprises a controller and means for providing the controller with a suitable signal or signals for determining running values of power applied to the RRE apparatus based upon the signal or signals.

19. A method for determining a coefficient of performance (hereinafter "COP") for a horizontally disposed participant utilizing an RRE apparatus of claim 18, where a COP value of 100% is referenced to the assumed ability of an average healthy 150 pound human to continuously deliver applied power at a 0.1 rate, and wherein the method comprises the steps of:

programming the participant's weight in the controller;

positioning the participant under the RRE apparatus in a horizontally disposed manner;

coupling the horizontally disposed participant's limb groups to the rope lines;

supporting or balancing the weight of the limb groups one against the other via respectively coupling the lines to opposite sides of the drive assembly;

coupling the drive assembly to the energy dissipative assembly;

drivingly elevating and lowering the limb groups in an alternate manner against a resistive mechanical impedance load presented by the energy dissipative assembly thereby applying power thereto;

dissipating the applied power as heat;

determining running values of applied power;

determining running values of the participant's COP according to the formula $$COP=K(Pwr/Wt)$$

where K is a dimensioned constant utilized to rectify units of measurement, Pwr is a signal representing the running applied power value and Wt is a signal representing the participant's weight; and presenting the participant's COP value to him or her.

20. RRE apparatus for use in cardiovascular stress testing of a horizontally disposed heart patient while the patient implements RRE, comprising:

pulley supported flexible lines respectively coupled to the extremities of the legs of the horizontally disposed heart patient;

a hand bar for the heart patient to hold on to and achieve stability as the patient implements RRE via drivingly elevating and lowering the legs;

a drive assembly coupled to the lines;

an energy dissipative assembly coupled to the drive assembly;

a combining and supporting structure;

a controller;

means for providing the controller with a suitable signal or signals for determining running values of power applied to the RRE apparatus based upon the signal or signals; and electrocardiographic equipment for collecting electrocardiographic data as the heart patient implements RRE;

the combination for nominally supporting or balancing the weight of the horizontally disposed heart patient's legs one against the other such that the heart patient is able to alternately apply lifting force to the left leg while pulling down on the right and then lifting force to the right leg while pulling down on the left, for dissipating power applied by the heart patient while he or she periodically elevates and lowers the legs in an alternate rhythmic manner, and for enabling the generation of a coefficient of performance produced by the heart patient concomitantly with the gathering of electrocardiographic data in order to test his or her cardiovascular capacity as he or she implements RRE.

21. A method for testing cardiovascular capacity of a horizontally disposed heart patient utilizing the RRE apparatus of claim 20 via generating running coefficient of performance (hereinafter "COP") values where a COP value of 100% is referenced to the assumed ability of an average healthy 150 pound human to continuously deliver applied power at a 0.1 rate, and wherein the method comprises the steps of:

programming the heart patient's weight in the controller;

hooking up the heart patient to the electrocardiographic equipment;

positioning the heart patient under the RRE apparatus in a horizontally disposed manner;

coupling the horizontally disposed heart patient's legs to the flexible lines;

supporting or balancing the weight of the legs one against the other via respectively coupling the lines to opposite sides of the drive assembly;

coupling the drive assembly to the energy dissipative assembly;

instructing the heart patient to drivingly elevate and lower the patient's legs in an alternate manner against a resistive mechanical impedance load presented by the energy dissipative assembly thereby applying power thereto;

dissipating the applied power as heat;

determining running values of applied power;

determining running values of the heart patient's COP according to the formula $$COP=K(Pwr/Wt)$$

where K is a dimensioned constant utilized to rectify units of measurement, Pwr is a signal representing the running applied power value and Wt is a signal representing the heart patient's weight;

presenting a target COP value to the heart patient;

presenting the heart patient's actual COP value to the patient;

increasing the target COP value as a function of time;

instructing the heart patient to observe the patient's actual COP value and keep it ahead of the increasing target COP value by exercising in a progressively more vigorous manner via higher repetition rates and/or longer stroke length;

terminating testing either when the heart patient is no longer able to exceed the increasing target COP value, or alternately, upon the heart patient encountering ischemia or any other irregularity; and evaluating resulting electrocardiographic data with reference to synchronously obtained COP values.

* * * * *

UNITED STATES PATENT AND TRADEMARK OFFICE

CERTIFICATE OF CORRECTION

PATENT NO. : 6,592,502 B1
DATED : July 15, 2003
INVENTOR(S) : Edward H. Phillips It is certified that error appears in the above-identified patent and that said Letters Patent is hereby corrected as shown below:

Column 17,
Line 29, replace “dTodt” with -- dTo/dt --.

Signed and Sealed this

Twentieth Day of January, 2004

JON W. DUDAS
*Acting Director of the United States Patent and Trademark Office*